US007419017B2

(12) United States Patent
Walker et al.

(10) Patent No.: US 7,419,017 B2
(45) Date of Patent: Sep. 2, 2008

(54) MULTI-SECTIONAL PERCUSSIVE DRILL BIT ASSEMBLY

(75) Inventors: Thomas A. Walker, Berlin, PA (US); Richard Smith, Morrisville, NY (US); Stephen R. Means, Punxsutawney, PA (US)

(73) Assignee: Keystone Drill Services, Inc., Somerset, PA (US)

( * ) Notice: Subject to any disclaimer, the term of this patent is extended or adjusted under 35 U.S.C. 154(b) by 0 days.

(21) Appl. No.: 11/563,350

(22) Filed: Nov. 27, 2006

(65) Prior Publication Data

US 2007/0095576 A1 May 3, 2007

Related U.S. Application Data

(63) Continuation-in-part of application No. 11/422,625, filed on Jun. 7, 2006.

(60) Provisional application No. 60/689,376, filed on Jun. 10, 2005.

(51) Int. Cl.
*E21B 10/36* (2006.01)

(52) U.S. Cl. ..... 175/413; 175/414; 175/415

(58) Field of Classification Search ..... 175/413, 175/414, 415

See application file for complete search history.

(56) References Cited

U.S. PATENT DOCUMENTS

| | | | | |
|---|---|---|---|---|
| 1,995,043 | A | | 3/1935 | Sanderson |
| 3,152,654 | A | | 10/1964 | Conover |
| 3,260,319 | A | | 7/1966 | Conover |
| 3,856,358 | A | | 12/1974 | Krekeler |
| 4,051,912 | A | | 10/1977 | White |
| 4,083,415 | A | | 4/1978 | Kita et al. |
| 4,085,809 | A | | 4/1978 | Lovell et al. |
| 4,466,498 | A | | 8/1984 | Bardwell |
| 4,919,221 | A | * | 4/1990 | Pascale ..... 175/415 |
| 5,113,594 | A | | 5/1992 | Ishihara et al. |
| 5,139,099 | A | | 8/1992 | Hayashi et al. |
| 5,150,636 | A | | 9/1992 | Hill |
| 5,322,139 | A | * | 6/1994 | Rose et al. ..... 175/414 |
| 5,787,999 | A | | 8/1998 | Holte |
| 5,975,222 | A | | 11/1999 | Holte |
| 6,021,856 | A | | 2/2000 | Pascale |

OTHER PUBLICATIONS

David J. Bagnell, Authorized Officer, International Search Report, PCT Application No. PCT/US06/39769, dated Apr. 30, 2007.

David J. Bagnall, Authorized Officer, Written Opinion of the International Searching Authority, PCT Application No. PCT/US06/39769, dated Apr. 30, 2007.

Lee W. Young, Authorized Officer, International Search Report, PCT Application No. PCT/US06/46338, dated Oct. 23, 2007.

(Continued)

*Primary Examiner*—Giovanna C Wright
(74) *Attorney, Agent, or Firm*—Beck & Thomas, P.C.

(57) ABSTRACT

A multi-sectional percussive drill bit assembly for drilling holes in earth formation primarily used in conjunction with a pneumatic percussive device. The drill bit assembly is comprised of an easily removable bit that is rotationally driven by a lug and pocket structure and axially limited in travel by means of retaining members.

11 Claims, 32 Drawing Sheets

OTHER PUBLICATIONS

Lee W. Young, Authorized Officer, Written Opinion of the International Searching Authority, PCT Applicatiion No. PCT/US06/46338, dated Oct. 23, 2007.

Web pages featuring Center Rock, Inc.'s Bit Viper Winged Reaming System acquired from centerrock.com between the end of Oct. 2007 up to Nov. 7, 2007; 2 pages; no date of earliest publication is known.

Web pages featuring ShinSung Industry Co., Ltd.'s SIS Winged Reaming System acquired from sshammer.com between the end of Oct. 2007 up to Nov. 7, 2007; 2 pages; no date of earliest publication is known.

* cited by examiner

MULTI-SECTIONAL PERCUSSIVE DRILL BIT ASSEMBLY

CROSS REFERENCE TO RELATED APPLICATIONS

This is a Continuation-In-Part application of prior Nonprovisional application Ser. No. 11/422,625, filed Jun. 7, 2006, which claims the benefit of U.S. Provisional Application Ser. No. 60/689,376 filed Jun. 10, 2005. This Application incorporates by reference Nonprovisional application Ser. No. 11/422,625, filed Jun. 7, 2006 and Provisional Application filed Jun. 10, 2005, Ser. No. 60/689,376.

BACKGROUND OF THE INVENTION

1. Field of the Invention

The present invention relates generally to large diameter pneumatic percussive hammers and more particularly to large drill bit assemblies with removable bit of the drill bit assembly.

2. Description of Related Art

It is known that the bit head of any drill bit assembly typically wears faster than a shank due to the aggressive environmental conditions at the working end of the drill bit assembly. Some drill bit assemblies are completely discarded even when the shank of the drill bit assembly is still operable. This is due to the fact that the bit head portion of the drill bit assembly is worn so severely that the bit head cannot be reconditioned back into working order.

It is well known historically that regular replacement of the bit head of the drill bit assembly, dressing of the bit assembly cutting elements in the bit head, or replacement of the entire drill bit would greatly increase the overall productivity of the drilling system. It is also well known that maintaining or replacing the entire drill bit assembly can be quite costly to the overall operation. The existing methods for replacing or redressing of the worn drill bit heads for large class drilling machines is expensive, labor intensive, and sometimes dangerous depending on the equipment utilized to perform the task. Dressing the cutting elements in a drill bit can be very labor intensive and in some cases cannot be done adequately enough at the jobsite, once again adding to the overall cost of the operation.

Therefore, every effort is taken to balance the necessity to keep the drill bit drilling effectively and at the same time attempts are made to reduce the cost of the operation by keeping the drill bit in service as long as possible. The intention of the bit head replacement is to keep the bit head of the drill bit assembly as effective as possible during its operation, but minimizing the cost of the drill bit assembly by making interchange of the bit head of the drill bit assembly simple, and with minimal labor time.

Also well known is the fact that large drill bit assemblies are more costly due to the specific machinery needed to manufacture such large drill bit assemblies and the necessity for costly large steel forgings to be provided. All of these points and the limited market size to sell such product to, drives the cost of these particularly large drill bit assemblies into a higher, sometimes unaffordable cost condition for most drilling operations of that size, unless no other means for drilling the earth formation is found suitable.

Many designs exist for attempting to replace the bit head of the drill bit assembly, but primarily have been focused on smaller drill bit assemblies, and the necessity to drag steel casing into the drilled hole behind the bit assembly.

U.S. Pat. No. 1,995,043 to Ray R. Sanderson shows the replacement of the cutting elements used in churn or percussion drilling. The forward working portion of the bit assembly is replaceable when worn.

U.S. Pat. Nos. 3,152,654 & 3,260,319 to Robert E. Conover shows percussion style drill bits with replacement sections that have been retained in position by solid retention pins and roll pins.

U.S. Pat. No. 4,051,912 to Kenneth M. White shows a bit assembly with a replaceable forward working section that is threaded and wedged together.

U.S. Pat. No. 4,083,415 to John F. Kita et al. shows a bit assembly with a replaceable forward working section that is affixed by means of steel balls secured by threaded plugs.

U.S. Pat. No. 4,085,809 to Robert Lovell et al. shows a drill bit assembly with a replaceable bit head and parts thereof that are assembled using a threaded design.

U.S. Pat. No. 4,466,498 to Allen E. Bardwell shows a drill bit assembly with replaceable bit heads that are affixed with the utilization of bolts or threaded fasteners.

U.S. Pat. No. 4,919,221 to Jack H. Pascale shows a drill bit assembly with a replaceable bit head that is attached and retained by a drive spline helix locking means.

U.S. Pat. No. 5,113,594 to Yoshimi Ishihara et al. & U.S. Pat. No. 5,139,099 to Takeshi Hayashi et al. show drill bit assemblies comprising of replaceable bit heads of the drill bit assembly but affixed in a fashion where the bit heads are capable of rotating within.

U.S. Pat. No. 6,021,856 to Jack H. Pascale shows a drill bit assembly with a replaceable bit head that is held in place by ring segments.

U.S. Pat. Nos. 5,787,999 & 5,975,222 to Adris L. Holte shows a drill bit assembly with replaceable retracting and extending arms used in the under-reaming system.

None of the prior art patents listed above or known contain consideration for rotationally driving the bit head with a set of lugs and retaining the bit head in the drill bit assembly by means of solid retaining members kept in place with roll pins for easy bit head removal and installation. Furthermore, several of the above mentioned patents attempt to rigidly affix the bit head of the drill bit assembly to the shank for percussive force energy transmission, which inherently has been found to limit the life expectancy of the retaining members. Furthermore, none of the above mentioned patents make mention or attempt to separate the drilling forces to better design force carrying members more suited for the application.

BRIEF SUMMARY OF THE INVENTION

It is the principal intent of the described invention to provide a new method and product for decreasing the overall cost for drilling large diameter earth formation holes by making it possible to easily replace the bit head of the drill bit assembly on a pneumatic percussive down-hole-hammer without the need for discarding the shank of the drill bit assembly, which seldom needs replacing or redressing.

Another objective of the invention is to provide greater utilization of the shank of the drill bit assembly by allowing varying size and design bit heads to be installed into the shank more effectively decreasing the cost of the overall system by reducing the costly inventory of multiple complete drill bits.

It is still yet another object of the described invention to allow for simple and safe replacement of the bit head of the drill bit assembly without the need to fully remove the entire drill bit assembly from the pneumatic percussive device. It is also desirable to perform the replacement of the bit head of the drill bit assembly without the need for expensive auxiliary equipment.

It is another object of the invention to be able to operate the described invention in either a clockwise or counter-clockwise rotational drilling direction without decrease in drilling performance or effectiveness.

It is another object of the invention to provide separation of the drilling forces or selectively apply or avoid the application of torsional forces on parts of the coupled shank and bit head, therefore to better the designs for the force carrying members making them more suitable for the specific forces and the application.

This invention provides for a method for coupling a shank with a drill bit to selectively apply or avoid the application of torsional forces on parts of the coupled shank and bit while rotating the shank relative to the bit. A shank having a shank passage that has a shank passage area is provided. A bit having a bit passage area is provided. A retaining member having a retaining member area that is less than the shank passage area and the bit passage area is provided. The shank has a complementary lug and pocket structure in which the shank has either a pocket or a lug and the bit has either a complementary lug or pocket in which the lug and pocket are engaged when the bit and the shank are rotationally engaged. When in operation the shank and the bit are engaged and the complementary lug and pocket structure are engaged. When engaged the shank passage area and the bit passage area are aligned. The retaining member is inserted through the aligned passages of the shank and bit. The shank is rotated relative to the bit while engaged. The lug and pocket structure receive all torsion forces applied and the retaining member has no torsion force applied while the shank and bit are rotating.

The invention also provides a method for coupling a shank with a drill bit to create a drill bit assembly that separates the application of drilling forces to separate parts of the drill bit assembly. A shank having a shank extraction load attachment member, shank torsional load member, and a shank percussive force member is provided. The shank extraction load attachment member, shank torsional load member and the shank percussive force member are all independent members from each other and part of the shank. A bit having a bit extraction load attachment member, a bit torsional load attachment member and a bit percussive force member is provided. The bit extraction load attachment member, the bit torsional load member, and the bit percussive force member are independent members from each other and part of the bit. The shank is engaged with the bit. The shank is engaged with the bit so that the shank extraction load attachment member engages the bit extraction load attachment member so that when the bit assembly is extracted, extraction force is on the extraction load attachment members and not the torsional load members or the percussive force members. The shank is engaged with the bit so that the shank torsional load member and the bit torsional load member are engaged so that when the bit assembly is rotating the rotational forces are on the torsional load members and not the extraction load attachment members or the percussive force members. The shank is engaged with the bit so that the shank percussive force member is engaged with the bit percussive force member so that when the bit assembly is being impacted upon the percussive force is on the percussive force members and not on the extraction load attachment members or the torsional load members.

This invention also provides a drill bit assembly. The drill bit assembly has a shank having a shank passage in a shank skirt section. The skirt section has an opening. The shank passage has a shank passage area. The shank passage starts at an outer surface of the shank skirt section and ends at an inner surface of the shank skirt section in the opening of the shank skirt section. The drill bit assembly has a bit having a center stud. The center stud has an area so that it can fit into the opening of the shank skirt section when the shank and bit are assembled. The center stud has a bit passage that has a bit passage area. When the shank and bit are assembled the bit passage and the shank passage are aligned. There is a retaining member having a retaining member area that is less than the shank passage area and the bit passage area. The retaining member is inserted into the shank passage and extends into the bit passage when the shank and bit are assembled. The retaining member is removable so that the bit and shank can be separated when the retaining member is removed. The shank can have a lug on the bottom or a pocket on the bottom. The bit can have a pocket or lug on the bottom.

The bit passage can be larger than the shank passage area. The reverse can also be used, namely the bit passage area can be smaller than the shank passage area.

A lug can have a lug surface normal to the direction of impact. A pocket can have a pocket surface normal to the direction of impact. The lug surface does not touch the pocket surface.

A pocket can have a wear pad.

A lug can have a wear pad.

The drill bit assembly can have a shank percussive force surface and a bit percussive force surface. The shank percussive force surface touches the bit percussive force surface.

A center stud can have a wear band. An opening can have a wear band.

The retaining member can be hollow, cylindrical, internally threaded, or rectangular or any combination of these configurations. The retaining member can be flexible. The retaining member can contain grooves for supporting impact energy isolators.

DETAILED DESCRIPTION OF THE PREFERRED EMBODIMENT

ILLUSTRATIVE DEFINITIONS AND EXAMPLES

Figure 1:
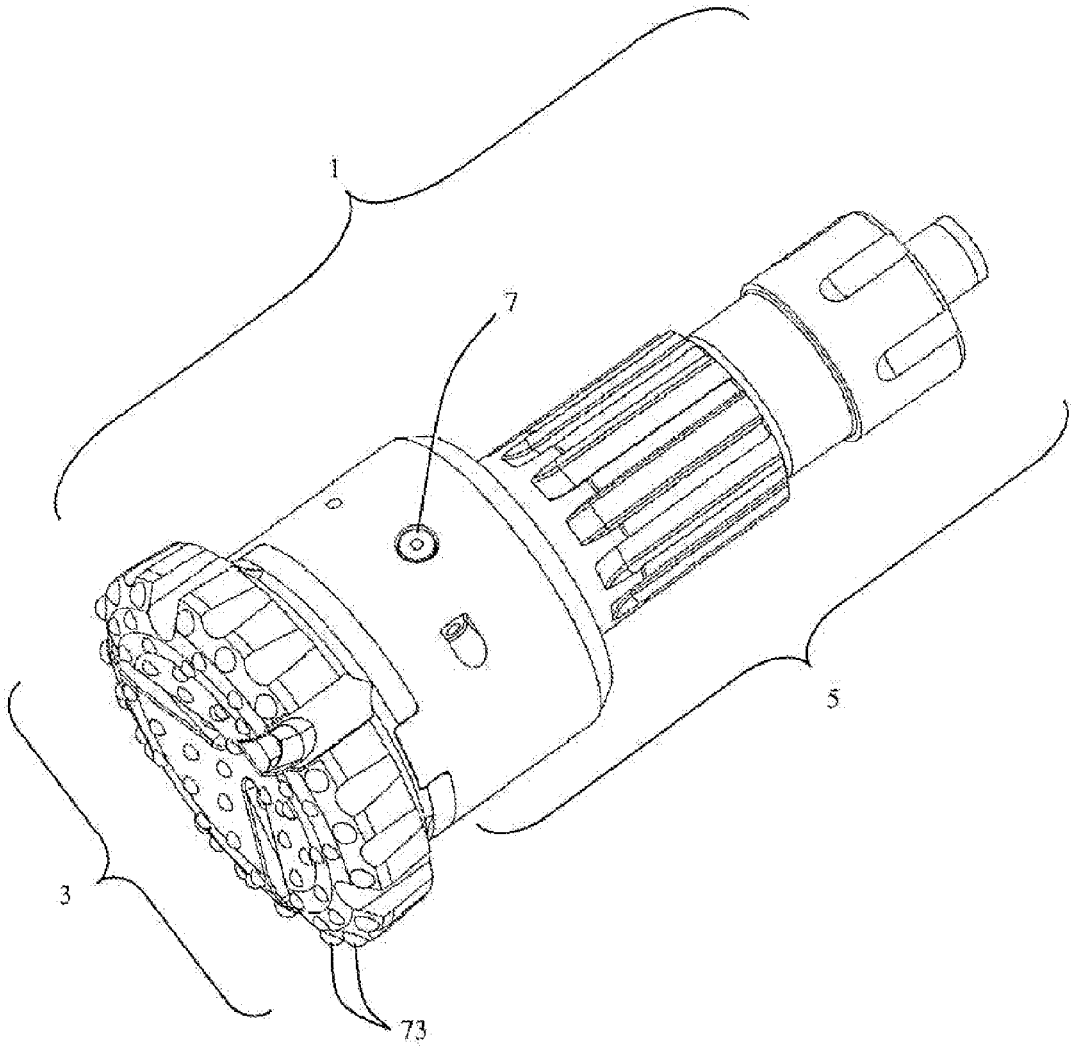
FIG. 1 is an isometric view of the drill bit assembly completely assembled depicting the bit and the shank engaged.

Drill Bit:

a. A replaceable impact receiving attachment that engages with an impact delivery device via methods where the drill bit is rotated by the impact delivery device and is retained to limit the drill bit axial movement with respect to the impact delivery device. The drill bit is used to transfer energy from the impact delivery device into the rock formation for fracturing, cutting and excavating.

b. An impact receiving mechanical device used to transfer impact energy or hammering energy into earth formation desired for excavating.

Drill Bit Assembly:

Components that when assembled produce a similar replaceable impact receiving attachment used in conjunction with an impact delivery device to excavate rock formation. The assembly typically separates the device engaging piece and the rock engaging piece (working portion). Therefore, allowing replacement of each of these pieces at independent intervals.

Shank:

a. The portion of a drill bit or drill bit assembly that engages or is the attaching part to the impact generating device.

b. The device impact receiving portion of the drill bit/drill bit assembly.

Bit:

The impact energy transmitting portion of the bit/bit assembly that engages the rock formation for excavation. The bit head can be designed into many shapes and configurations. It usually contains rock cutting or fracturing elements that are of a harder or more wear resistant substance.

Coupling a Shank with a Drill Bit:

By separating the shank portion of a drill bit and the working portion of the drill bit into separate bodies it is necessary to develop a method of attaching or co-joining the pieces. Coupling means to bring together or join with limited relative independent travel, in this case by mechanical parts.

Selectively Apply or Avoid the Application of Torsional Forces on Parts of the Coupled Shank and Bit:

Thru mechanical design the separation of forces that are produced during the operation of the drill bit assembly in communication with an impact generating device, can be achieved. One such force is torsional or rotational force due to the nature of the bit assembly device needing to be rotated during operation to aid in the excavation of the earth formation.

Passage:

A path, channel, groove, hole, slot or duct through, over, along or thru which something may pass. One such passage in this design represents the opening that is used to guide the retaining member.

Passage Area:

Is the cross-sectional area and cross-sectional shape of the passage in both the shank portion and in the bit head portion. It can be the diameter of a hole or the width of a channel or a groove.

Retaining Member:

A component that couples the bit and the shank. A component that is contained within the shank passage and the bit head passage that limits the axial travel of the co-joined bit head with respect to the shank portion of the drill bit assembly. It can have a circular cross sectional area. It can have a rectangular cross sectional area to provide a planar contact surface as opposed to the circular cross sectional area that provides only a line contact surface.

Retaining Member Area:

The describing of the cross-sectional area and cross-sectional shape of the retaining member. If the retaining member is round it would be the diameter of the retaining member. The retaining member area could be the parameter of a rectangle.

Complementary:

A system relating to one another or matching components. It can be an integral system for transmitting specific forces such as rotational forces.

Lug:

Protrusion or projection or stem that extends beyond a normal working surface for engaging a complementary receptacle.

Pocket:

An impression or recess for receiving a lug or stem to facilitate the transmittal of rotational forces in the bit assembly.

Lug and Pocket Structure:

The combined system of the lug and pocket.

Lug and Pocket are Engaged:

When the lug is slideably mated into the pocket. All surfaces of the lug do not have to contact all surfaces of the pocket.

Rotationally Engaged:

When rotational forces are applied to the shank via the impact generating device, and when drag or rotational resistance is generated on the outer portion of the bit head due to frictional forces between the bit head and the rock formation, a surface on the lug, parallel to the direction of impact, engages a surface on the pocket, parallel with the direction of impact, and the system becomes—rotationally engaged.

Engaging the Shank with the Bit:

Moving the shank and the bit into position to connect with each other for operation. An example includes sliding the bit head stud portion into the shank portion cavity.

Engaging the Complementary Lug or Pocket Structure:

Moving the lug or the pocket into position to connect with each other for operation.

Shank Passage Area and Bit Passage Area are Aligned:

Being able to freely pass the retaining member through the shank passage area into the bit passage area or vice versa. An example of this is while the complementary lug and pocket structure are engaged a hole in the shank is matched with a hole in the bit so that the retaining member can pass through both holes and join the bit and shank.

The Retaining Member does not Touch an Interior Surface of the Bit Passage While Engaged:

When rotational forces are applied to the shank portion via the impact generating device, and when drag or rotational resistance is generated on the outer portion of the bit head due to frictional forces between the bit head and the rock formation, the retaining member does not touch an interior surface.

Interior Surface of the Bit Passage:

Any surface that aids in the creation of the shape of the bit head passage, which the retaining member could contact if not limited in travel.

Rotating the Shank Relative to the Bit While Engaged:

Moving the shank around an axis and because the shank is connected to the bit in turn moving the bit around an axis. An example is when the bit is held by rotational drag forces in the earth formation hole and by drag force developed between the bit head face (feature of the bit head that engages the rock) and the rock, the shank portion rotates and makes contact between the lug and pocket surfaces.

Lug Surface Normal to the Direction of Impact:

Lug Surface that does not engage the pocket structure during rotational operation or impact operation of the bit assembly in the impact-generating device. An example of this is the horizontal surface on the top of the lug.

Pocket Surface Normal to the Direction of Impact:

Pocket structure surface that does not engage any lug surface during rotational operation or impact operation of the bit assembly in the impact-generating device. An example of this is the horizontal surface on the bottom of the pocket.

Normal to the Direction of Impact:

Defined as a plane created normal to the central axis of the shank portion. As an example it could be a horizontal plane.

Wear Pad:

A replaceable piece that would carry a load made from a material with qualities desirable for the application. It could be a ring.

Shank Percussive Force Surface:

The shank portion surface that makes contact with bit head that is normal to the direction of impact. The surface is the plane of energy transmission from the shank portion to the bit head during operation.

Bit Percussive Force Surface:

The bit head surface that makes contact with the shank portion that is normal to the direction of impact. The surface is the plane of energy transmission from the shank portion to the bit head during operation.

Bit Center Stud:

A feature of the bit head used to engage the shank portion.

Wear Band:

A replaceable piece that would carry a load made from a material with qualities desirable for the application. It could be a ring.

Shank Opening:

The design feature in the shank portion that receives the bit head for co-joining geometrically shaped similar to the bit head stud.

Impact Energy Isolators:

Something for reducing or eliminating impact energy transmission from one body to another.

Separates the Application of Drilling Forces:

Drilling forces are comprised of rotational forces needed to turn the bit assembly in the earth formation hole so that the bit cuts or delivers impact energy into a fresh portion of rock needing to be excavated. Another force required is impact force, which is generated by the tool the bit assembly is coupled to. The impact forces are needed to fracture the rock formation. Another force required for the operation is extraction force. The extraction force is the axial force required to remove the drilling tool and bit assembly from the earth formation hole. Dividing these forces and applying them to specific components of the assembly. This allows the specific components to be more precisely designed for the specific separated force.

Shank Extraction Load Attachment Member:

The feature of the shank portion of the bit assembly that the extraction force is applied to. An example would be the shank passage.

Shank Torsional Load Member:

The feature of the shank portion of the bit assembly that the torsional or rotational force is applied to. An example would be the pocket or lug structure.

Shank Percussive Force Member:

The feature of the shank portion of the bit assembly that the percussive force is applied to for transmitting the impact energy from the shank portion to the bit head portion. An example is the shank percussive force surface.

Independent Members:

Each member or feature is independent from the other so that only a specific force is applied to a specific member. The members can be part of a unitary piece but could be separate for each other. For example the shank passage, the shank lug, and the shank percussive force member are all part of the shank but are all separate members.

Bit Extraction Load Attachment Member:

The feature of the bit head of the bit assembly to which the extraction force is applied. An example is the bit passage.

The Bit Torsional Load Member:

The feature of the bit head of the bit assembly to which the torsional or rotational force is applied. An example is a lug or a pocket.

Bit Percussive Member:

The feature of the bit head of the bit assembly to which the percussive force is applied. An example is the bit percussive force surface.

Shank Skirt Section:

The shank portion is comprised of a section that engages the impact-generating device and a portion for receiving the bit head stub for assembly. To prevent the shank portion from traveling to far up into the impact-generating device a larger diameter than the diameter of the engaging portion of the shank is used. The section from the shoulder created by the differences in diameter toward the lug or pocket engaging system is defined as the skirt section. The skirt section can have the receiving opening for the bit head stub.

Outer Surface of the Shank Skirt Section:

The outer most surface in a radial direction from the axial centerline in the shank skirt section of the shank portion.

Inner Surface of the Shank Skirt Section:

In the area where the bit stub engages the shank portion there is an inner surface. The inner most surface in a radial direction from the outer shank skirt section inward.

The Retaining Member is Inserted into the Shank Passage and Extends into the Bit Passage:

The retaining member with a similar but smaller geometrical shape as the passage of the bit section and passage of the shank portion can be inserted into the shank portion in the shank skirt section and continue until it enters the bit passage. The retaining member is long enough to remain in the shank passage and extend into the bit passage.

Receiving Portion of the Bit:

The receiving portion of the bit is the area where the shank portion engages the bit head portion. It is the area where the lug and pocket structure is.

Lug and Pocket Communicate the Rotational Forces:

When the lug and pocket structure are engaged and rotational forces are applied to the shank portion of the drill bit assembly, the lug and pocket structure communicate the rotational forces between the shank portion and the bit head portion.

Retaining Member Contains Grooves:

Grooves formed radially on the retaining member are used to hold o-rings that are used to help minimize the amount of impact energy transferred into the retaining members during impact operation.

Retaining Member is Flexible:

The retaining member is typically thought of as being rigid, but it could be considered flexible to help absorb any abnormal non-uniform axial loading during bit assembly extraction from the drilled earth formation hole.

Rotating the Shank Relative to the Bit:

Do to tolerances and design clearance between the lug and pocket structure some relative rotational movement could occur between the bit head and the shank. Attempting to rotate the shank relative to the bit would engage the lug and pocket surfaces that are parallel to the direction of impact.

Extraction Force:

The axial force required to remove the bit assembly from the earth formation drilled hole. The extraction force could be a vertical force compounded with the drag forces reacting between the outer surface of the bit head and the drilled hole or it could be a horizontal axial force which would be purely drag forces generated between the outer surface of the bit head and the drilled hole.

Engaging the Shank Extraction Load Attachment Member with the Bit Extraction Load Member:

Engagement is accomplished through the retaining member, which axially couples the bit head to the shank. By exerting an axial extraction force on the shank, the retaining member makes contact with the shank. The extraction force is then communicated through the retaining member into the bit head and the bit head is extracted from the drilled hole.

Engaging the Shank Torsional Load Member and the Bit Torsional Load Member:

During the drilling operation rotational forces are applied to the shank through the impact generating device. Those rotational forces are transmitted through the lug and pocket structure, which are considered to be the torsional load members. An example of the shank torsional load member would be the lug, and the bit torsional load member would be the pocket.

Engaging the Shank Percussive Force Member with the Bit Percussive Force Member:

The surfaces that make contact between the bit and the shank that transmit impact energy from the shank to the bit. By pushing the bit and shank together the surfaces that make contact after axial movement are the surfaces that represent the percussive force members for the bit and the shank.

Bit Assembly is being Impacted Upon:

When the impact generating device is operated it produces impacts that are captured by the bit assembly—primarily the shank first and then the energy is transmitted into the bit. You can picture this similarly to a hammer and a chisel. The chisel is impacted upon by the hammer.

During Drilling:

When the drill bit assembly is rotating downward into the earth and excavating the earth. An example is when the bit and the shank are rotationally engaged and the bit percussive force surface is touching the shank percussive force surface.

Description

FIG. 1 shows a drill bit assembly 1 having a shank 5 for connection to a fluid driven drilling device and a bit 3 limited in axial travel with respect to the shank 5 by means of a retaining member 7 and is rotationally engaged via lugs 67 and pockets 16. The lugs 67 and pockets 16 cannot be seen in FIG. 1.

Figure 2:
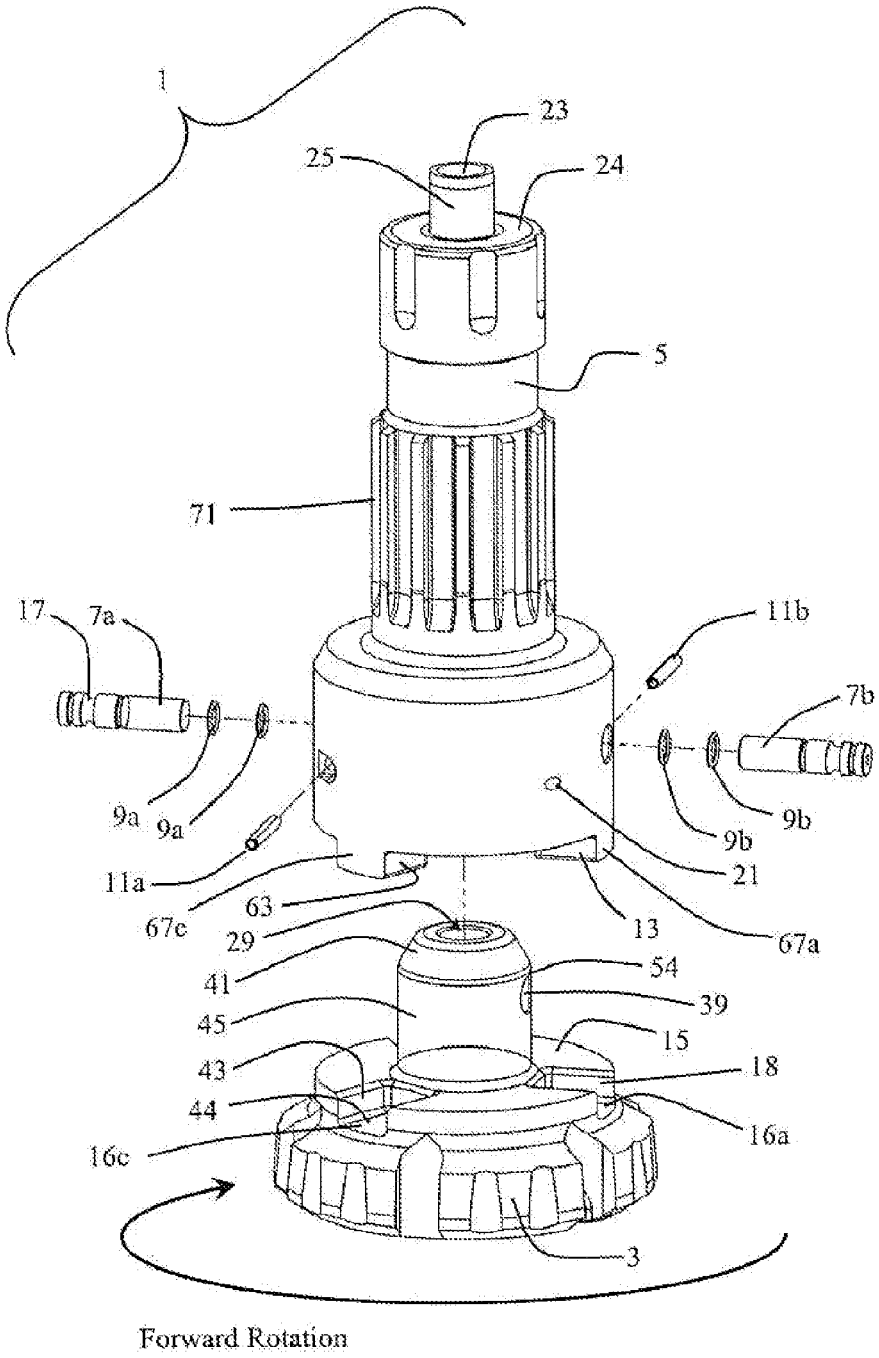
FIG. 2 is a vertical exploded isometric view of the design showing the method for retaining the bit in the shank and showing the complementary lug and pocket structure for rotationally driving the bit during operation.
Figure 3:
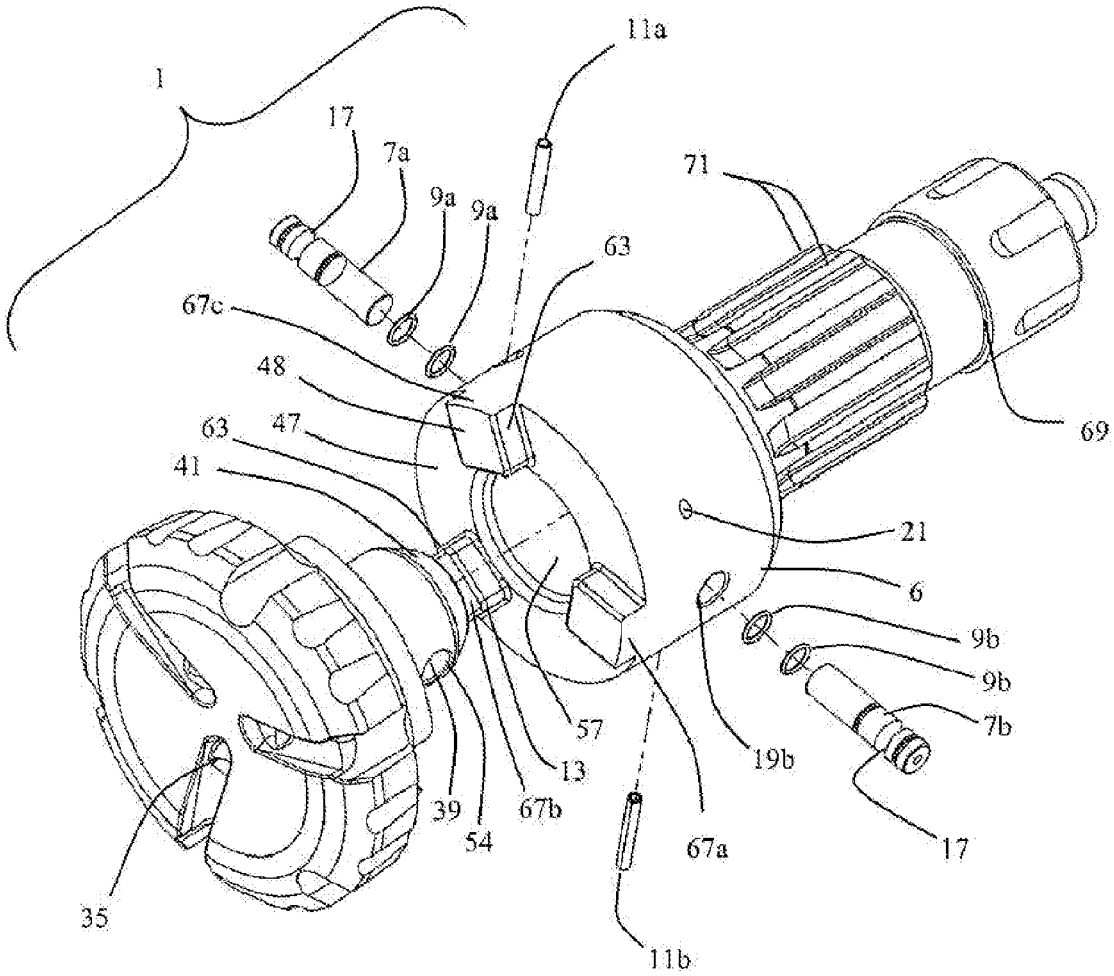
FIG. 3 is a side exploded isometric view showing the method for retaining the bit in the shank and showing the complementary lug and pocket structure for rotationally driving the bit during operation.
Figure 4:
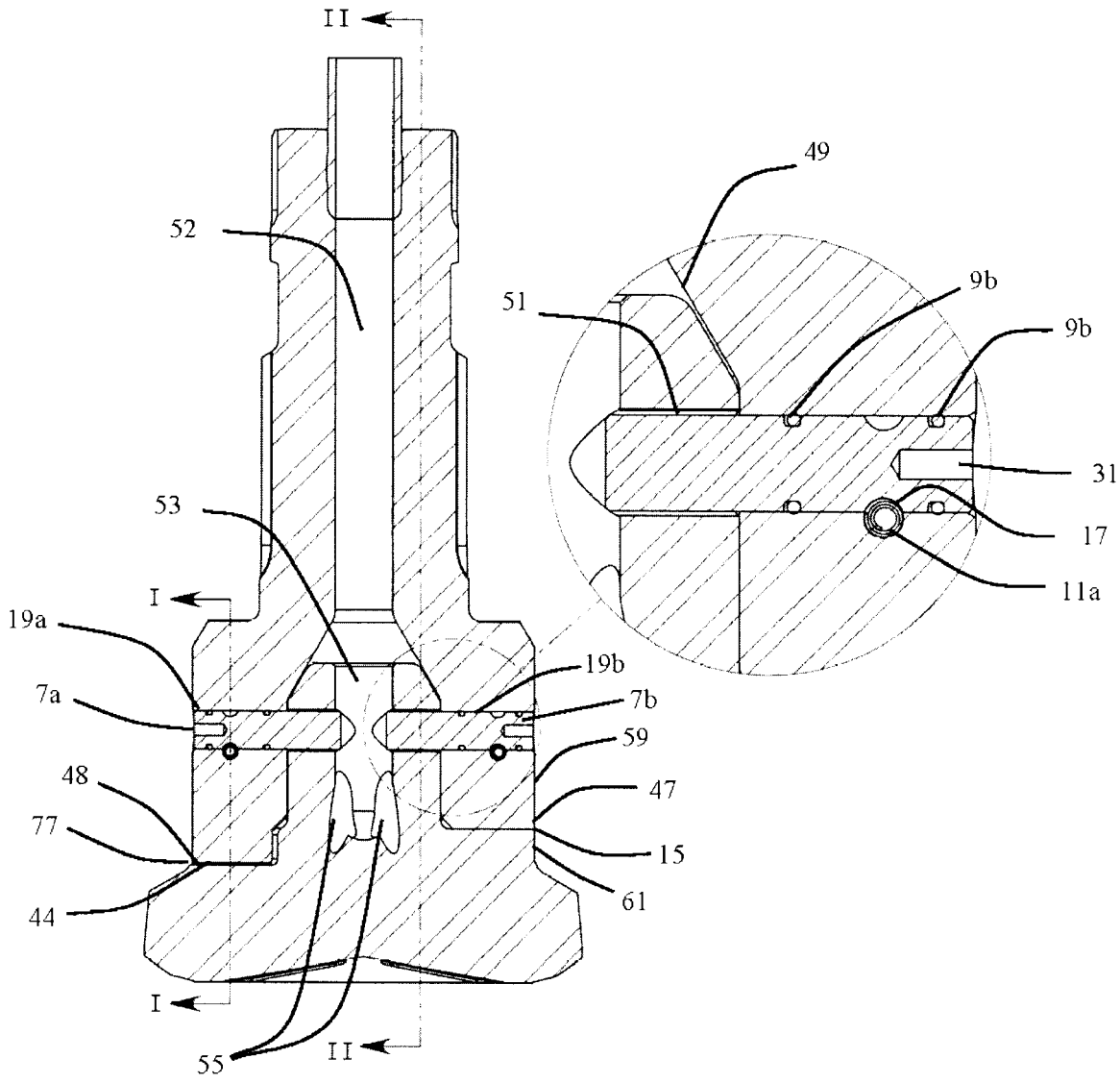
FIG. 4 contains a cross-sectional view of the drill bit assembly with a magnified view of the retaining member.

FIGS. 2, 3, and 4 show one embodiment of the drill bit assembly. The drill bit assembly 1 is rotated by means of the drilling device thru drive splines 71 on shank 5 and retained in the drilling device on upper shank shoulder 69. Fluid used to operate the drilling device enters the drill bit assembly 1 thru exhaust tube 25 and exits the drill bit assembly 1 thru exhaust porting 35 in the bit 3.

The percussive force of the impact energy is delivered from the drilling device and received thru shank impact surface 24 and carried thru the shank 5 where it is then transferred from a shank percussive force surface 47 into a bit percussive force surface 15 which make contact with each other. The percussive force is then transferred from the bit 3 thru the cutting elements 73 (shown in FIG. 1) into the earth formation for excavation.

Figure 13:
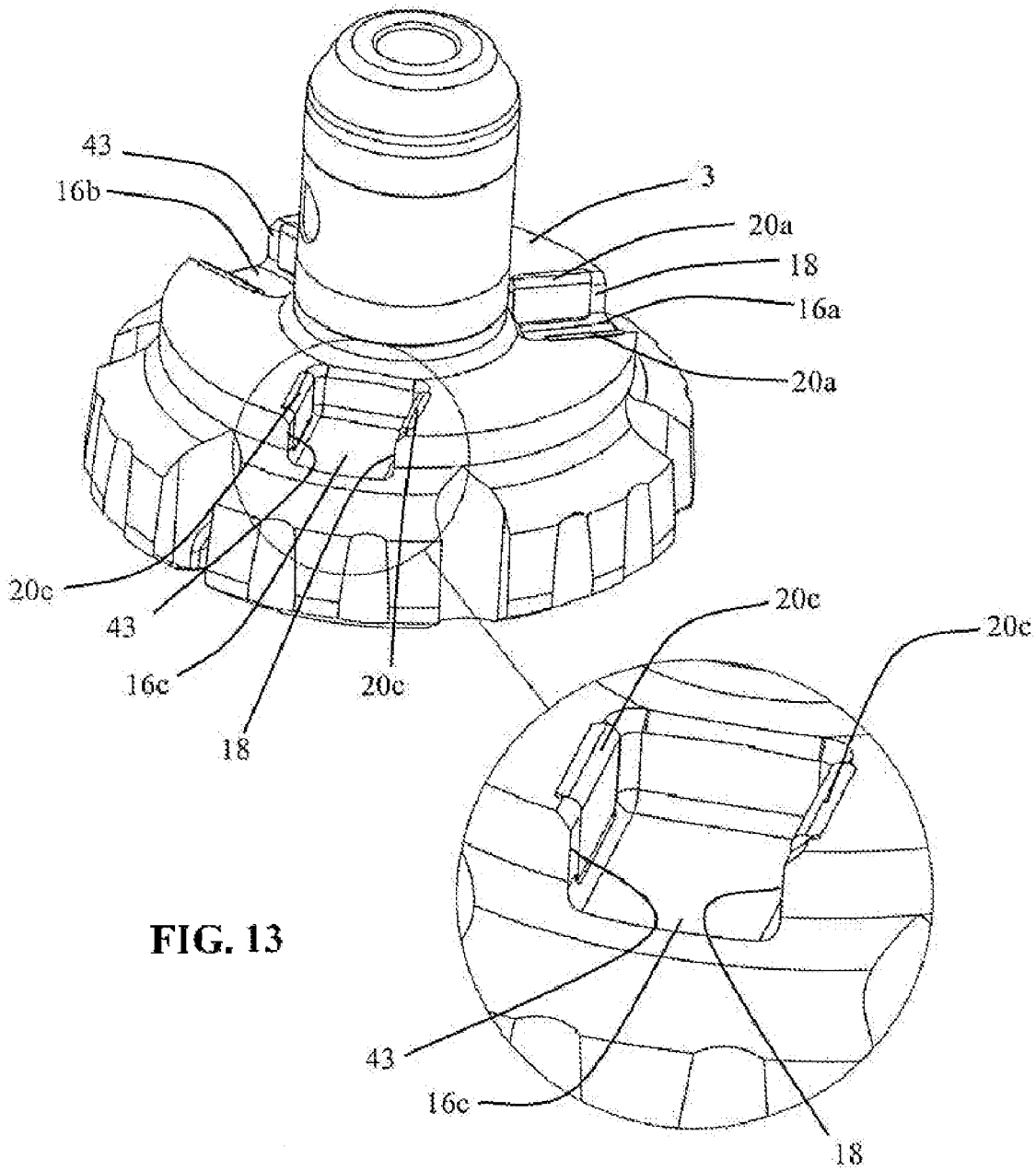
FIG. 13 is an isometric view of a drill bit assembly with wear band on the bit containing a magnified view of the pocket.

Bit 3 is rotationally driven by the complementary structure of lugs 67*a*, 67*b*, and 67*c* and pockets 16*a*, 16*b*, and 16*c* (all three pockets are shown in FIG. 13). The shank 5 is rotated causing lugs 67*a*, 67*b*, and 67*c* to make contact with pockets 16*a*, 16*b*, and 16*c*, which causes bit 3 to rotate. Lugs 67*a*, 67*b*, and 67*c* all have a lug surface normal to the direction of impact 48 that does not make contact with a pocket surface normal to the direction of impact 44 of pockets 16*a*, 16*b*, and 16*c* in the axial direction. This creates gaps 77 between the lugs 67*a*, 67*b*, and 67*c* and the pockets, 16*a*, 16*b*, and 16*c*. Only one gap 77 is shown in FIG. 4 however, it is understood that the gaps exist for all of the pockets and lugs. Because of the gaps 77 there is no percussive force transferred from lugs 67*a*, 67*b*, and 67*c* to pockets 16*a*, 16*b*, and 16*c* when percussive force is applied during the drilling process.

The bit 3 has pockets 16*a*, 16*b*, 16*c*, and a center stud 45 that engage the shank opening 57 in the shank skirt section 6 of the shank 5. A bit passage 39 is located in the center stud 45 of bit 3, which engages retaining members 7*a* and 7*b* only during axial extraction of the drill bit assembly 1 from the excavated earth formation hole. This is accomplished by having shank passages 19*a* and 19*b* that have areas that are smaller than a bit passage 39 area. Retaining members 7*a* and 7*b* have end cross sectional areas less than the areas of shank passages 19*a* and 19*b*, and less than the bit passage 39 area.

Pockets 16*a*, 16*b*, and 16*c* in bit 3 are engaged by lugs 67*a*, 67*b*, and 67*c* of shank 5. The pockets 16*a*, 16*b*, and 16*c* all have clockwise bit surfaces 43 and counterclockwise bit surfaces 18. The lugs 67*a*, 67*b*, and 67*c*, all have clockwise shank surfaces 13 and counterclockwise shank surfaces 63. The pockets 16*a*, 16*b*, and 16*c* engage the lugs 67*a*, 67*b*, and 67*c* and clockwise shank surfaces 13 make contact slideably with bit surfaces 43 during clockwise drilling operation. The lugs 67*a*, 67*b*, and 67*c* engage the pockets 16*a*, 16*b*, and 16*c* and counterclockwise shank surfaces 63 slideably make contact with counterclockwise bit surfaces 18 during counterclockwise drilling operation. The lugs 67*a*, 67*b*, and 67*c* of the shank 5 never become disengaged with the pockets 16*a*, 16*b*, and 16*c* of the bit 3 while the retaining members 7*a* and 7*b* are installed in the drill bit assembly 1, allowing rotational forces to be transmitted from the shank 5 to the bit 3 during drilling operation or extraction operation.

Figure 4A:
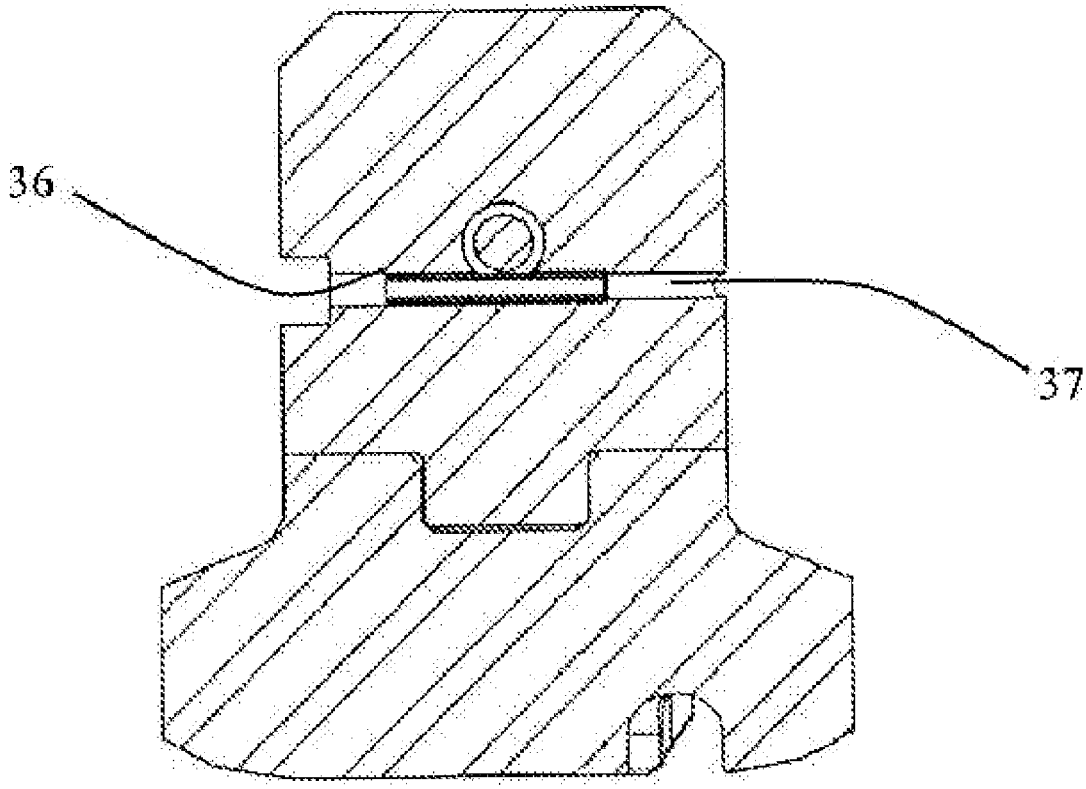
FIG. 4*a* is a sectional view along line I-I of FIG. 4 of the retaining member thru the shank and bit.
Figure 4B:
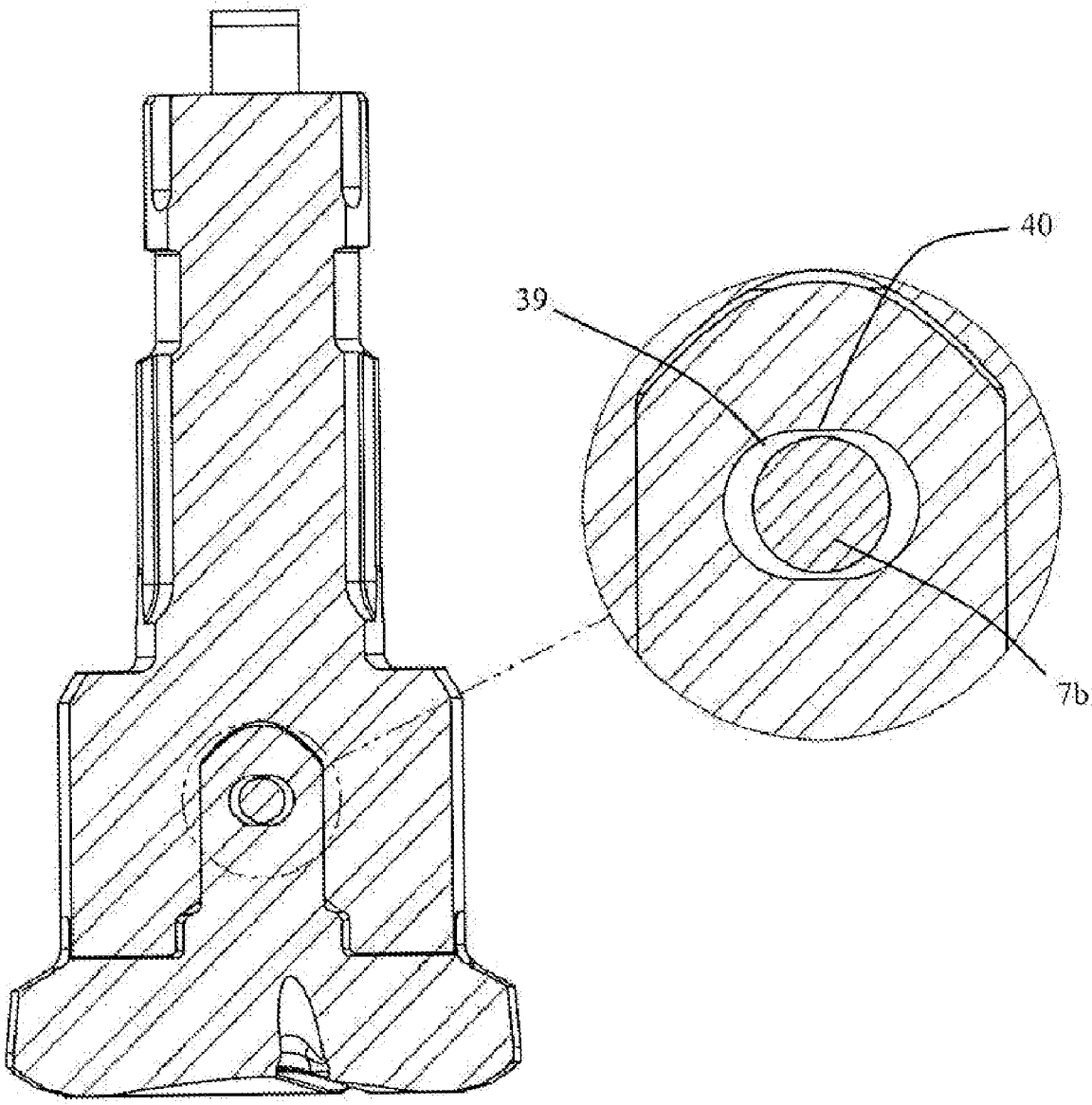
FIG. 4*b* is a sectional view along line II-II of FIG. 4 of the retaining member thru the shank and bit.

The retaining member 7 and bit passage 39 geometry is shown in FIG. 4*b*. The bit passage 39 area is oblong shaped and includes a flat portion 40 to insure that during drilling operation and bit 3 extraction from the excavated earth formation hole that rotational forces are not carried thru the retaining member 7. Alternatively the bit passage 39 geometry can be circular. When the bit passage 39 geometry is circular rotational force is not carried thru the retaining member 7 during drilling. However, with the circular bit passage 39 because of tolerances when the drill bit assembly 1 is being extracted from a hole a small amount of the rotational forces can be on the retaining member 7.

Shank 5 has an exhaust tube 25 with air exhaust path 23 that allows fluid to pass into the drill bit assembly 1. Fluid from shank 5 exits bore 52 and enters bit 3 thru center stud bore 53 and exits center stud bore 53 of bit 3 thru internal exhaust porting 55 of bit 3.

The shank 5 contains drive splines 71 for rotationally engaging the drilling device during operation.

Assembly of the drill bit assembly 1 consists of aligning bit passage 39 with a flat portion 40 of bit 3 with shank passages 19*a* and 19*b* of shank 5, and aligning pockets 16*a*, 16*b*, and 16*c* of bit 3 with lugs 67*a*, 67*b*, 67*c* of shank 5. While alignment exists, the center stud 45 of bit 3 is axially positioned into shank opening 57 of shank 5 until contact is made with bit percussive force surface 15 of bit 3 and shank percussive force surface 47 of shank 5.

Figure 18:
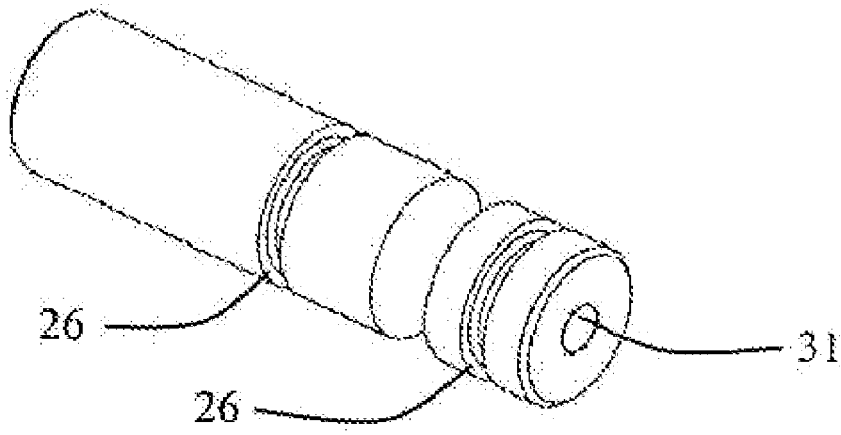
FIG. 18 is a side plan of the retaining member.
Figure 18A:
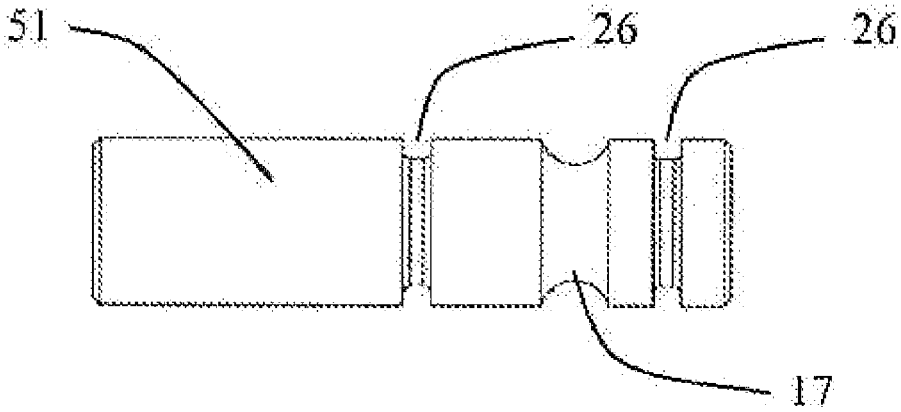
FIG. 18*a* is an isometric view of the retaining member.
Figure 19:
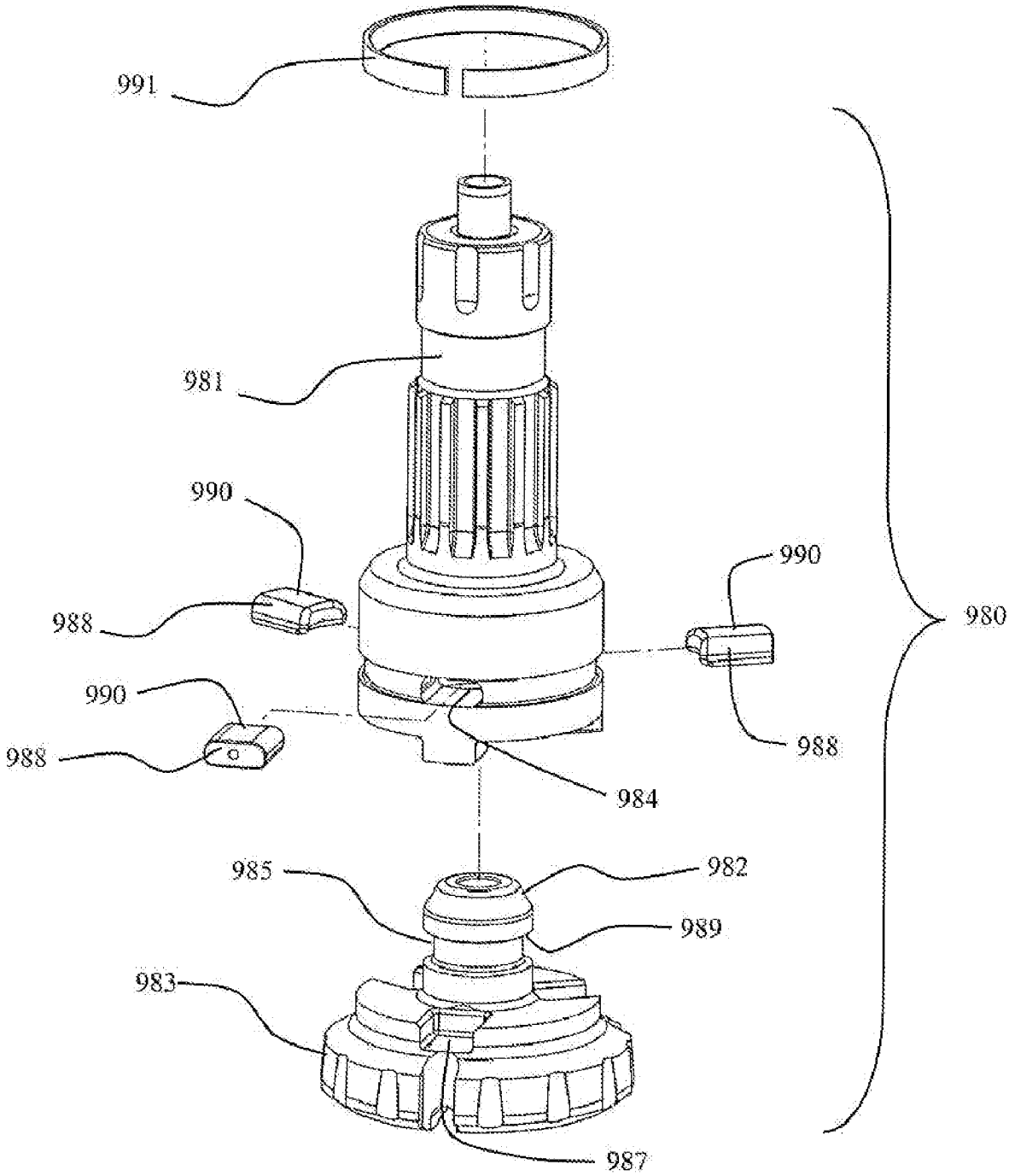
FIG. 19 is an exploded isometric view of another embodiment of the bit assembly.
Figure 20:
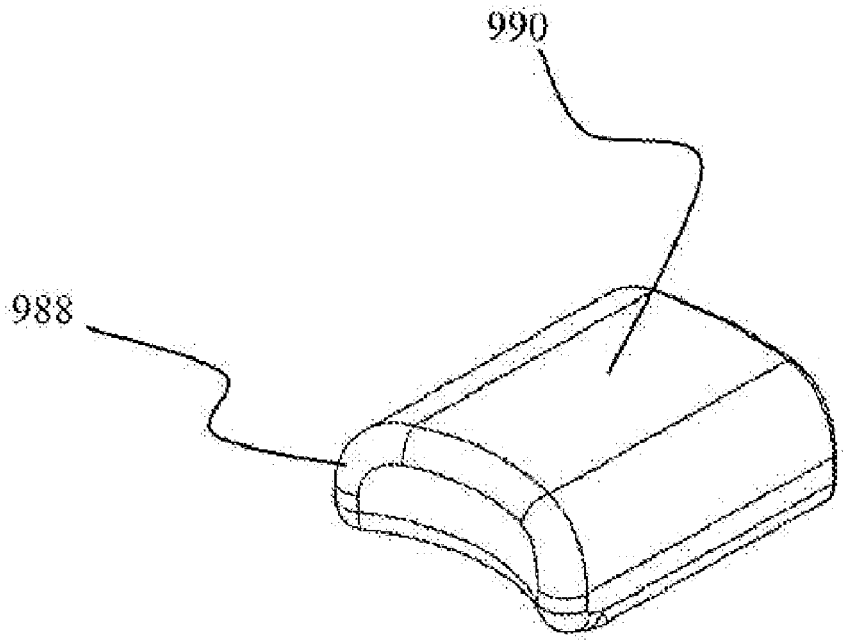
FIG. 20 is an isometric view of another embodiment of a retaining member.
Figure 20A:
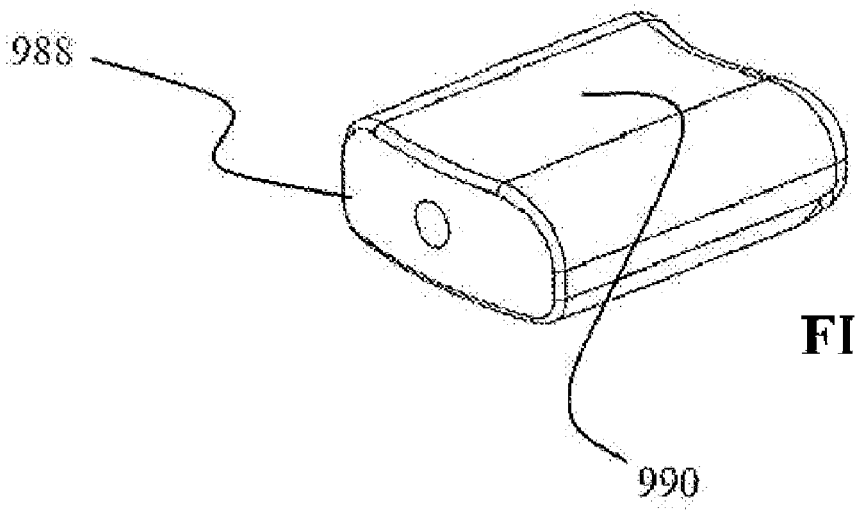
FIG. 20*a* is an isometric view of the retaining member shown in FIG. 20.
Figure 21:
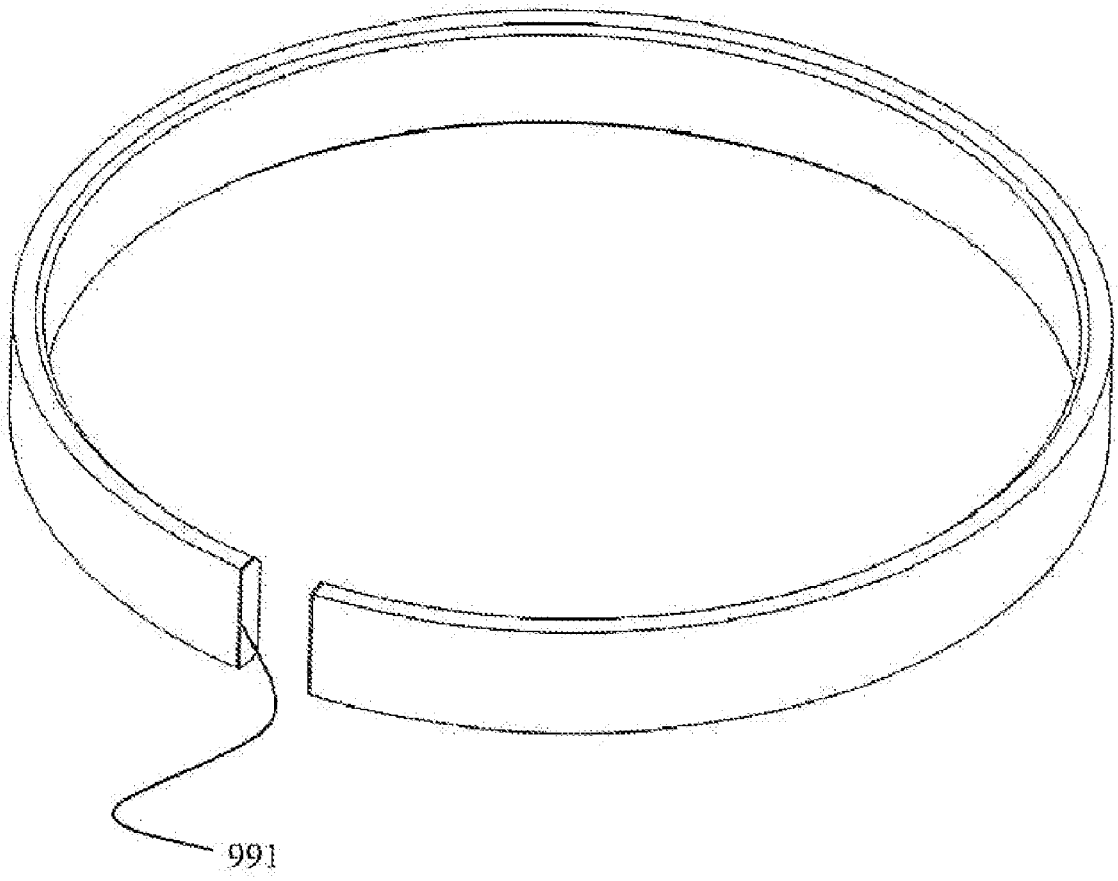
FIG. 21 is an isometric view of a band.
Figure 22:
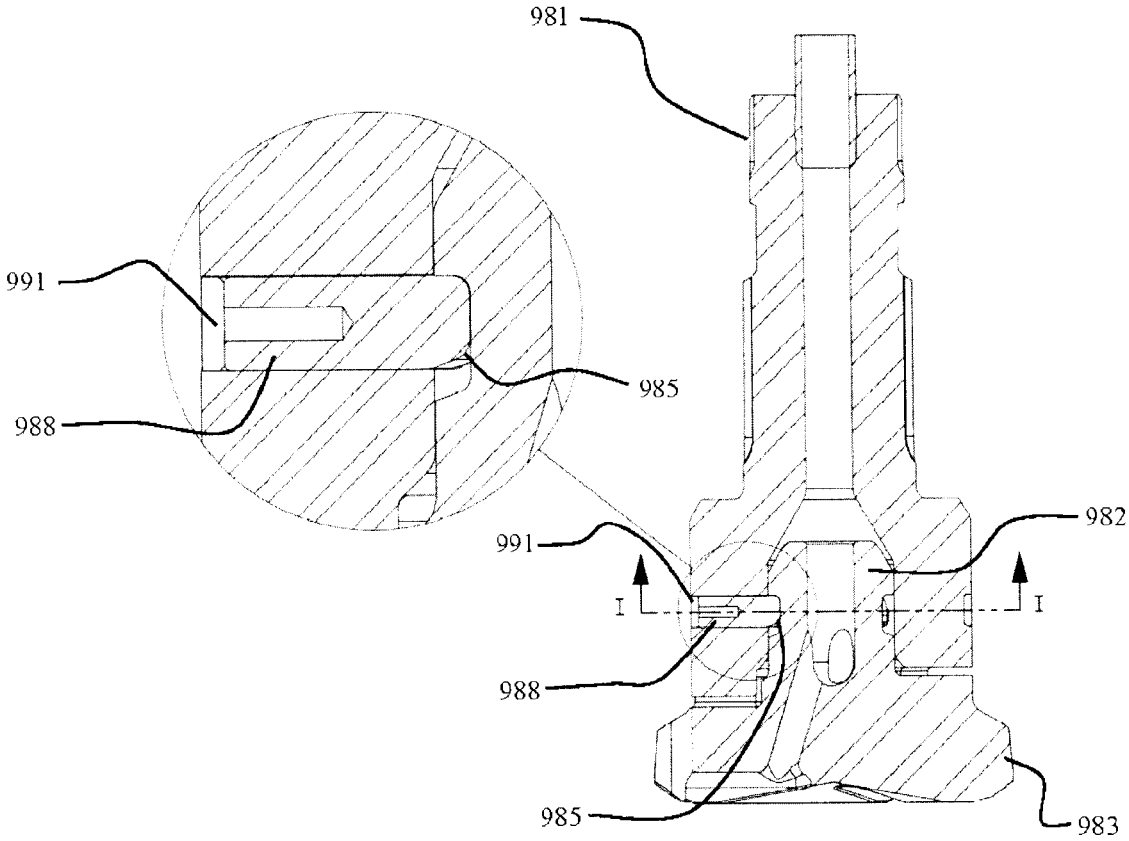
FIG. 22 is a sectional elevation view of another embodiment of the bit assembly.
Figure 23:
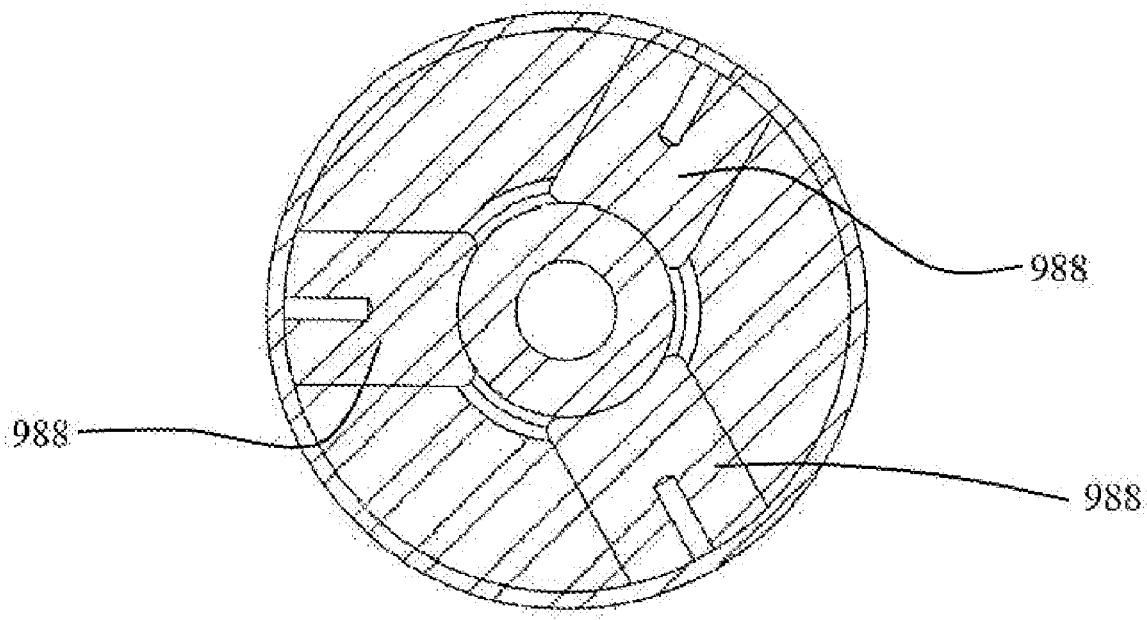
FIG. 23 is a view in section along I-I of the bit assembly shown in FIG. 22.

Isometric o-ring sets 9*a* and 9*b* are installed onto retaining members 7*a* and 7*b* by placing isometric o-ring sets 9*a* and 9*b* into provided grooves 26 (FIGS. 18, 18*a*) on retaining members 7*a* and 7*b*. The isometric o-ring sets 9*a* and 9*b* in grooves 26 of retaining members 7*a* and 7*b* are used to reduce the amount of impact energy transmission into the retaining members 7*a* and 7*b*. Impact energy is transferred from shank 5 to retaining members 7*a* and 7*b*. The bit passage 39 has a larger area than the area of the retaining members 7*a* and 7*b* and therefore the retaining members 7*a* and 7*b* do not touch the bit passage 39 during drilling or when impact energy is placed on shank 5. Because retaining members 7*a* and 7*b* do not touch the bit passage 39 no impact energy is transferred from retaining members 7*a* and 7*b* to the bit 3. It is noted that the structure of the passage can be reversed. The bit passage area can have a passage area that is smaller than the shank passage area so that when a retaining member is inserted, the retaining member does not touch the shank passage area when drilling or when impact energy is placed on the shank.

The isometric o-ring sets 9*a* and 9*b* also provide seals to restrict airflow thru the annulus created by shank passages 19*a* and 19*b* and the retaining member area 51 (FIG. 18) of the retaining members 7*a* and 7*b*. Retaining members 7*a* and 7*b* both have retaining member grooves 17. The retaining members 7*a* and 7*b* with isometric o-ring sets 9*a* and 9*b* installed in grooves 26 are positioned into shank passages 19*a* and 19*b* of shank 5 until retaining member grooves 17 on retaining member 7*a* and 7*b* are in line with roll pin entry holes 37. The retaining member 7*a* and 7*b* should be protruding into bit passage 39 of bit 3. Roll pins 11*a* and 11*b* are installed into roll pin entry holes 37 on shank 5 until roll pins 11*a* and 11*b* stop on roll pin hole shoulder 36 created between roll pin entry hole 37 and roll pin extraction hole 21 of shank 5. See FIG. 4*a* a view along line A-A of FIG. 4 for a view of installed roll pins 11*a* and 11*b* holding retaining members 7*a* and 7*b* by engaging retaining member grooves 17. No contact is made between retaining members 7*a* and 7*b* and the bit passage 39 of bit 3 during normal drilling operation. Once retaining members 7*a* and 7*b* are installed in shank 5, the drill bit assembly 1 may be lifted and positioned for drilling. While the drill bit assembly 1 is lifted, the retaining members 7*a* and 7*b* through the bit passage 39 carry the weight of the bit 3.

The drill bit assembly 1 is axially retained to the drilling device by shank shoulder 69 of shank 5 and rotationally engaged on the drive splines 71 of shank 5. The axial force from the drilling device pushes the drill bit assembly 1 down upon the earth formation and shank percussive force surface 47 of shank 5 contacts bit percussive force surface 15 of bit 3. Contact is not made between the shank 5 and the bit 3 axially at any other location. A center stud gap 79 exists between shank opening surface 49 of shank 5 and center stud surface 41 of bit 3. Lug surfaces normal to the direction of impact 48 of shank 5 do not make contact with pocket surfaces normal to the direction of impact 44 of bit 3. Gaps 77 are established during normal drilling operation between lug surfaces normal to the direction of impact 48 of shank 5 and pocket surfaces normal to the direction of impact 44 of bit 3. The contact between shank 5 and bit 3 during normal drilling operation for impact energy transmission occurs between shank percussive force surface 47 of shank 5 and bit percussive force surface 15 of bit 3.

Shank outer surface 59 of the shank 5 is the same size as the bit outer surface 61 of the bit 3 to create a uniform outer surface between the two portions.

Extraction of the drill bit assembly 1 from the drilled earth formation hole consists of an axial force required to pull the drill bit assembly 1 from the earth formation hole. The weight of the bit 3 of drill bit assembly 1 and the drag force of the bit 3 within the earth formation hole helps engage the retaining members 7*a* and 7*b* on bit passage surface 54 of bit 3. Rotational torque during extraction of the drill bit assembly 1 from the drilled earth formation hole is still carried via the lugs 67*a*, 67*b*, and 67*c* and pockets 16*a*, 16*b*, 16*c*, which make engagement thru clockwise shank surface 13 of lugs 67*a*, 67*b*, and 67*c* and bit clockwise surface 43 of pockets 16*a*, 16*b*, and 16*c* for clockwise rotation and counterclockwise shank surface 63 of lugs 67*a*, 67*b*, and 67*c* and counterclockwise bit surfaces 18 of pockets 16*a*, 16*b*, and 16*c* during counterclockwise rotation. No portion of the rotational torque is carried through retaining member 7*a* and 7*b*.

Disassembly of the drill bit assembly 1 begins by driving roll pins 11*a* and 11*b* from roll pin entry holes 37 by utilizing a hardened steel punch appropriately sized for a roll pin extraction holes 21, which are slightly smaller in diameter than the roll pin entry holes 37. A drilled and threaded tapped hole 31 exists in the retaining members 7*a* and 7*b* to aid in extraction of the retaining member 7*a* and 7*b* from shank passages 19*a* and 19*b*. Once the roll pins 11*a* and 11*b* have been removed from the roll pin entry holes 37, a piece of threaded rod or a pre-manufactured slide hammer can be affixed to the retaining members 7*a* and 7*b* by threading into the threaded tapped hole 31. Pulling on the threaded rod or operating the slide hammer will extract the retaining members 7*a* and 7*b* from the shank passages 19*a* and 19*b*. After both retaining members 7*a* and 7*b* have been removed from shank passages 19*a* and 19*b* of shank 5, the shank 5 can be lifted from the bit 3, disengaging center stud 45 of bit 3 with shank opening 57 of shank 5.

Figure 5:
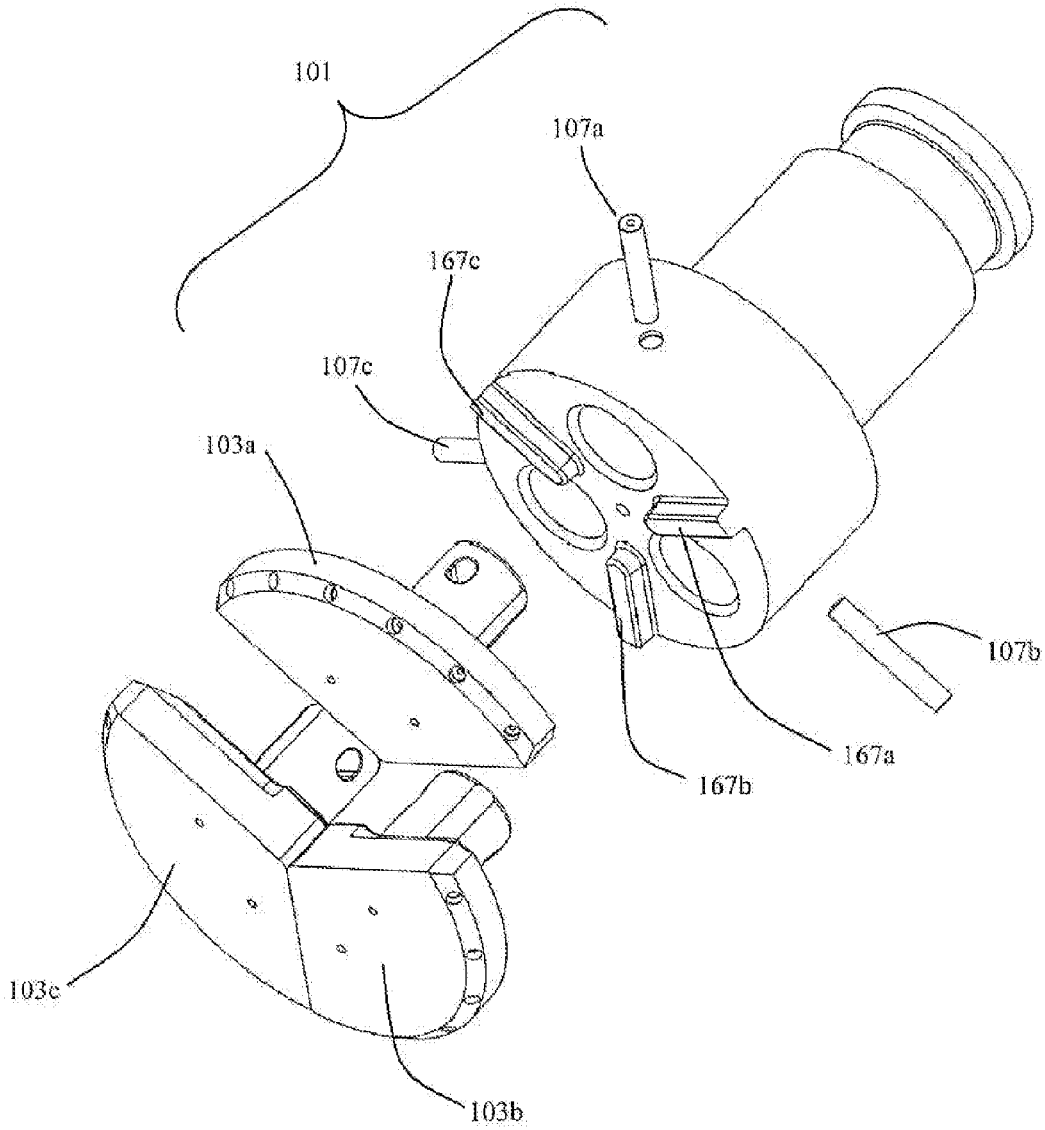
FIG. 5 is an isometric exploded view of multi-piece bit attached to a shank.

FIG. 5 shows alternate embodiment. Drill bit assembly 101 utilizes a three piece bit 103*a*, 103*b*, and 103*c* compared to the one-piece bit 3 described in the first embodiment. The design with the drive lugs 167*a*, 167*b*, and 167*c* and the retaining members 107*a*, 107*b*, and 107*c* is similar to the previous described system.

Figure 5A:
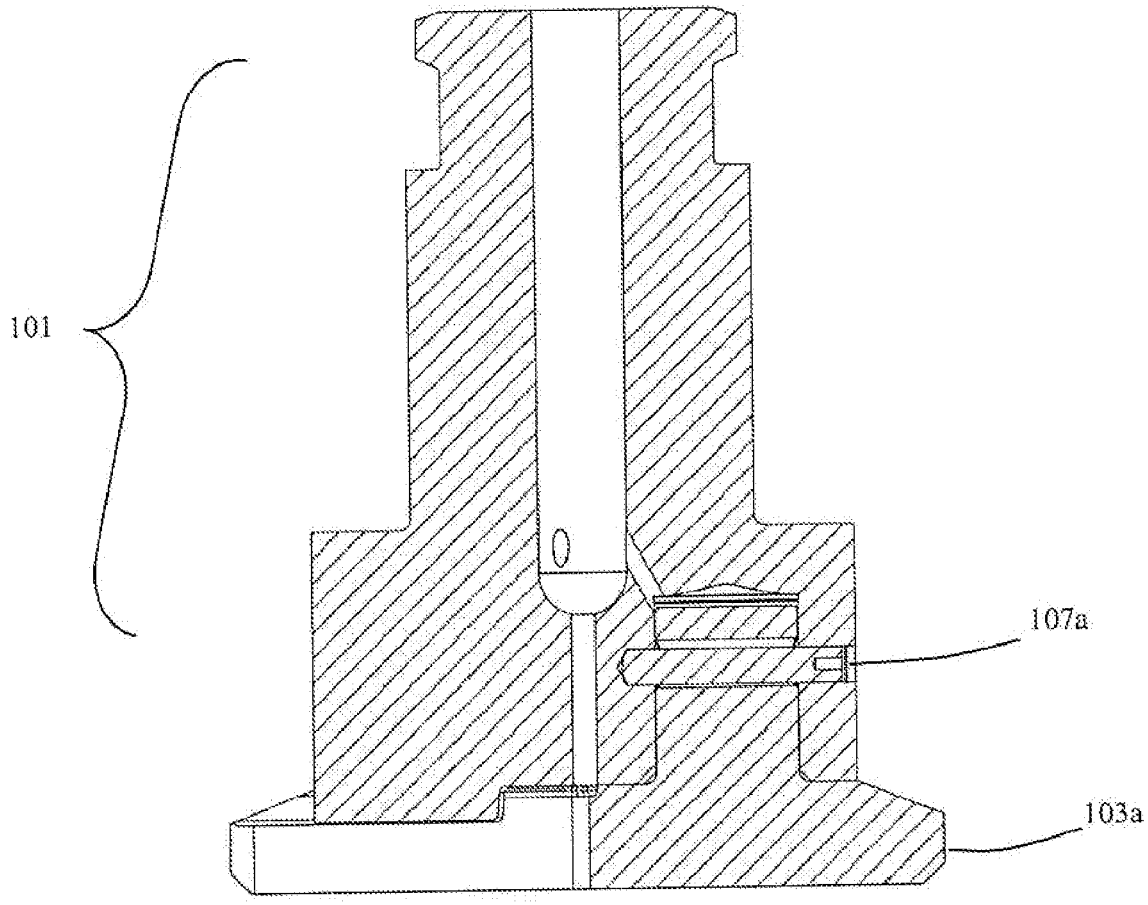
FIG. 5*a* is a cross-sectional view of multi-piece bit attached to a shank.

FIG. 5*a* shows drill bit assembly 101 in section with bit piece 103*a* with retaining member 107*a*.

Figure 6:
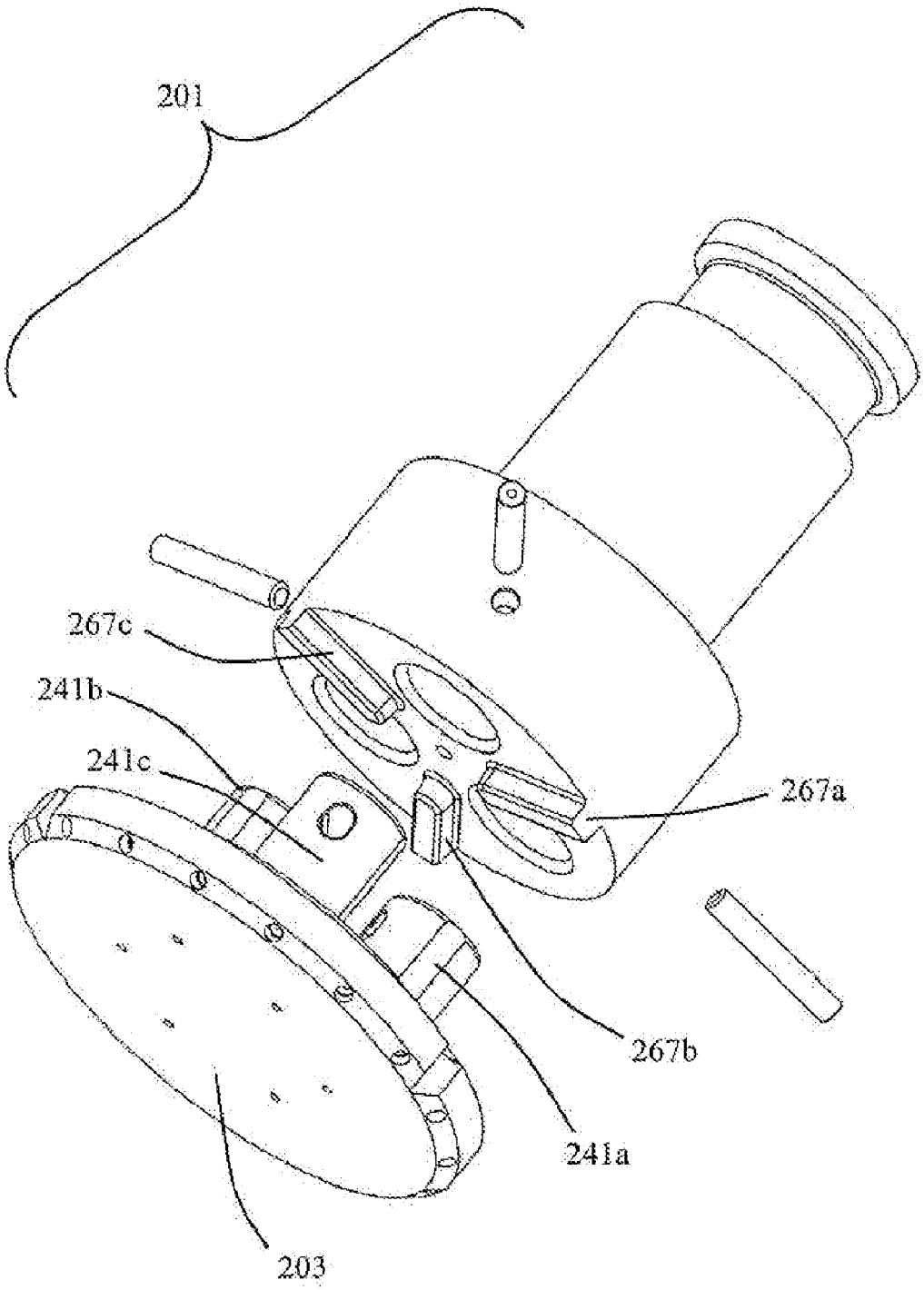
FIG. 6 is an isometric exploded view of a single bit with three studs for rotationally driving and retaining the bit.

FIG. 6 shows an alternate embodiment. Drill bit assembly 201 with bit 203 utilizes center studs 245*a*, 245*b*, and 245*c* and the drive lugs 267*a*, 267*b*, and 267*c* to transmit rotational power to the bit 203 from the shank 205.

Figure 7:
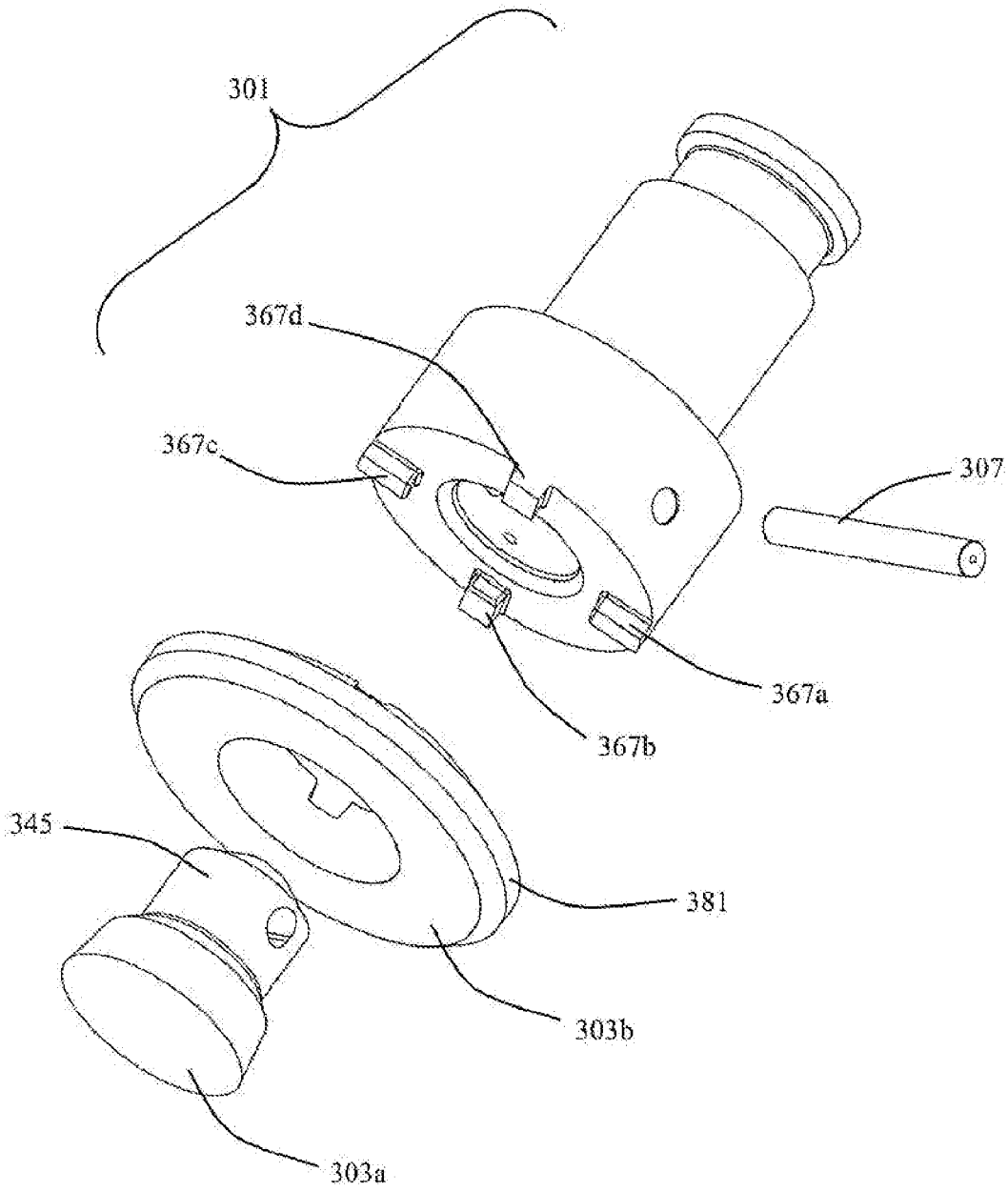
FIG. 7 is an isometric exploded view of a tapered lock outer ring design—single bit.

FIG. 7 shows an alternate embodiment. Drill bit assembly 301 has a two-piece bit 303*a* and 303*b* that is assembled utilizing a tapered locking system between the center stud 345 of bit 303*a* and the outer ring 381 of bit 303*b*. The retaining member 307 and drive lugs 367*a*, 367*b*, 367*c*, and 367*d* work substantially the same as are described in the first embodiment.

Figure 7A:
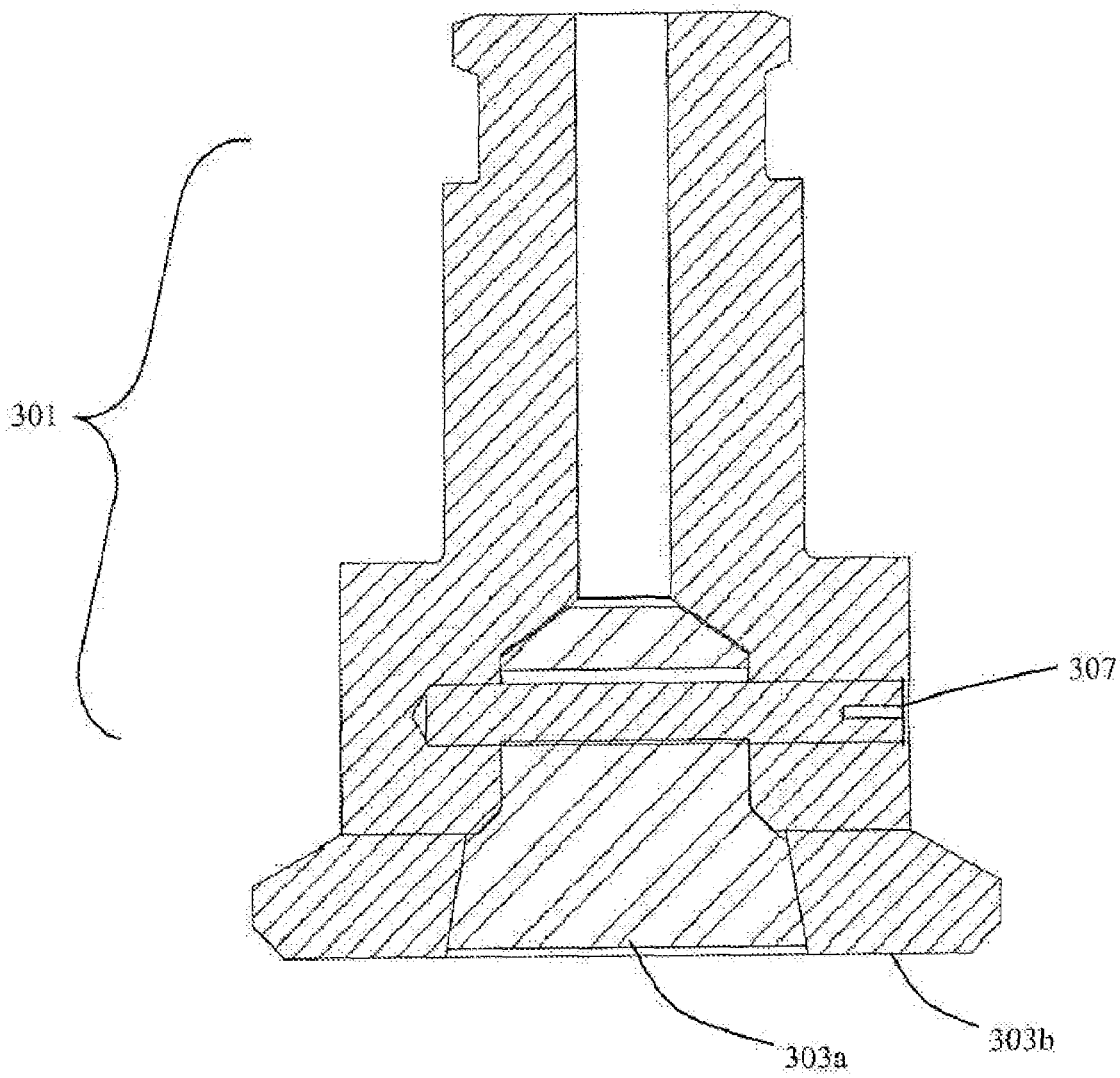
FIG. 7*a* is a cross-sectional view of a tapered lock outer ring design—single bit.

FIG. 7*a* shows a sectional view of drill bit assembly 301 with the two-piece bit 303*a* and 303*b* and retaining member 307.

Figure 8:
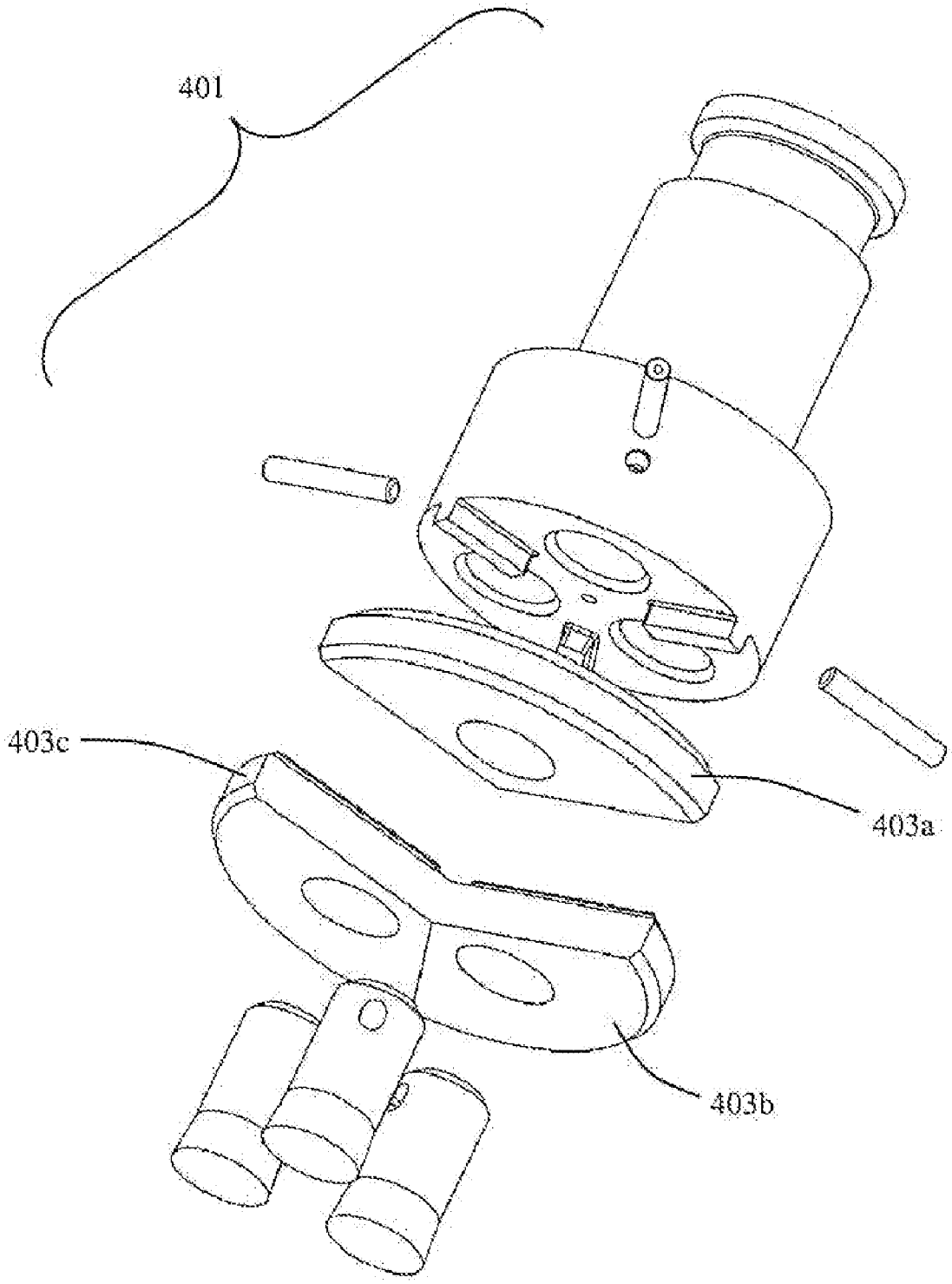
FIG. 8 is an isometric exploded view of multiple section tapered lock working bits.

FIG. 8 shows an alternate embodiment. Drill bit assembly 401 has a combination of the tapered lock design shown FIG. 7 and 7*a* utilizing a three piece bit 403*a*, 403*b*, and 403*c*.

Figure 9:
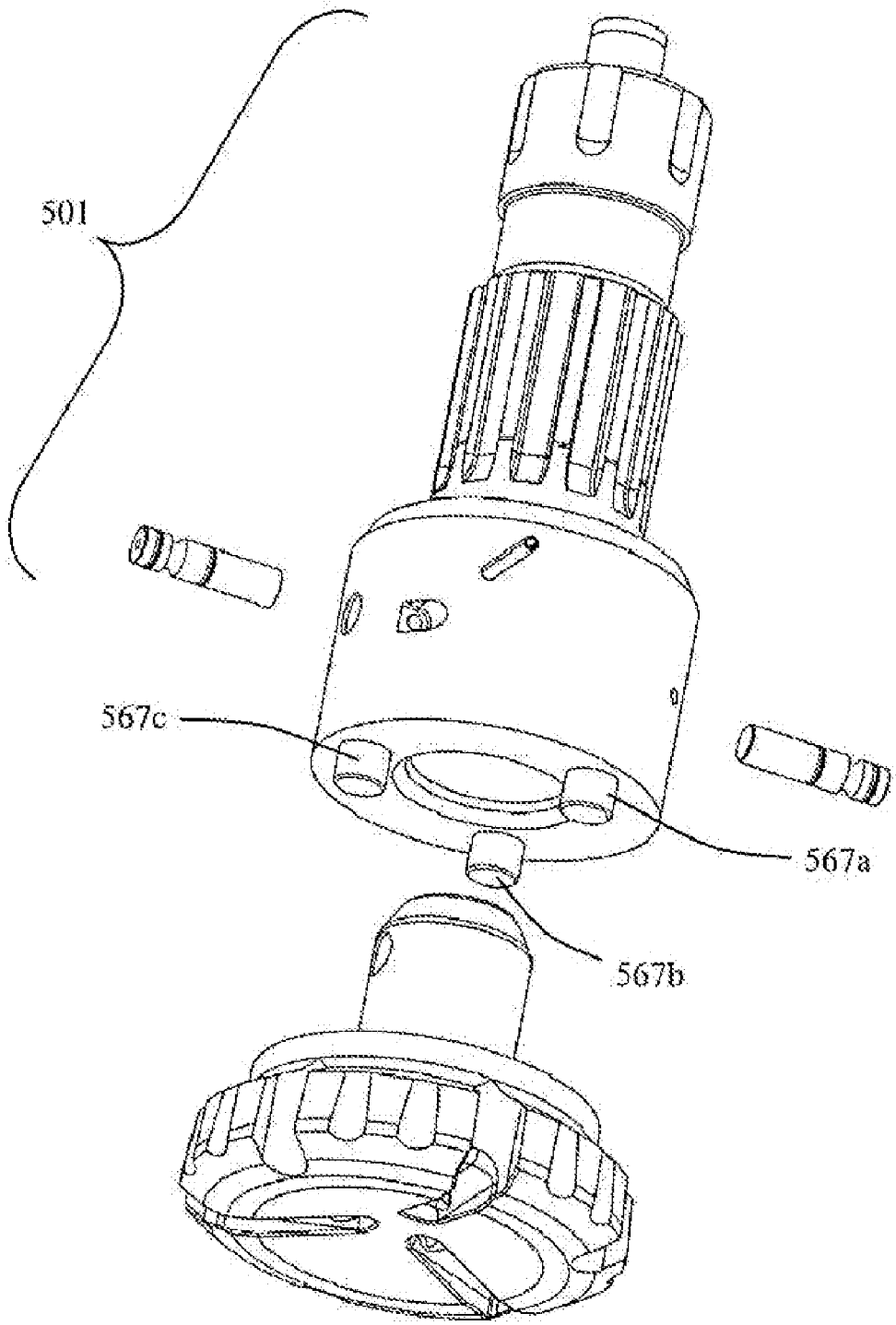
FIG. 9 is an isometric exploded view of lugs pressed into the shank.

FIG. 9 shows an alternate embodiment. Drill bit assembly 501 has a similar concept described in the first embodiment with exception for the utilization of pressed in cylindrical drive lugs 567*a*, 567*b*, 567*c*.

Figure 10:
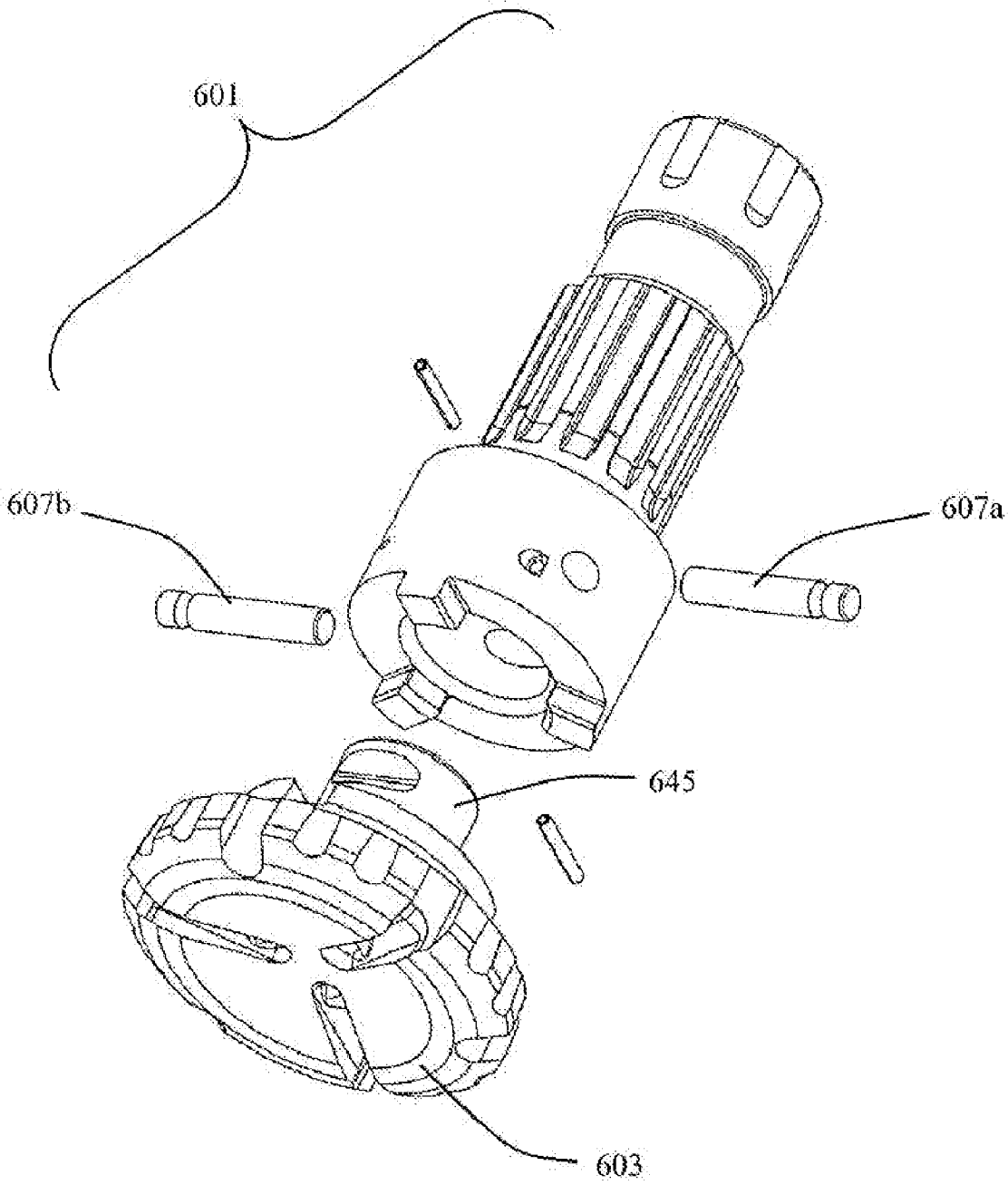
FIG. 10 is an isometric exploded view of a drill bit assembly having two retaining members engaging the outer surface of the center stud of the bit.

FIG. 10 shows an alternate embodiment. Drill bit assembly 601 has a similar drive lug system as mentioned in the first embodiment with the exception of the retaining members 607*a* and 607*b*. Retaining members 607*a* and 607*b* engage the bit 603 on the outer diameter of the center stud 645 versus the first embodiment retaining members 7*a* and 7*b* engage thru the center stud 45. The design generates more area to carry the extraction force during drill bit assembly 601 extraction from the earth formation hole.

Figure 10A:
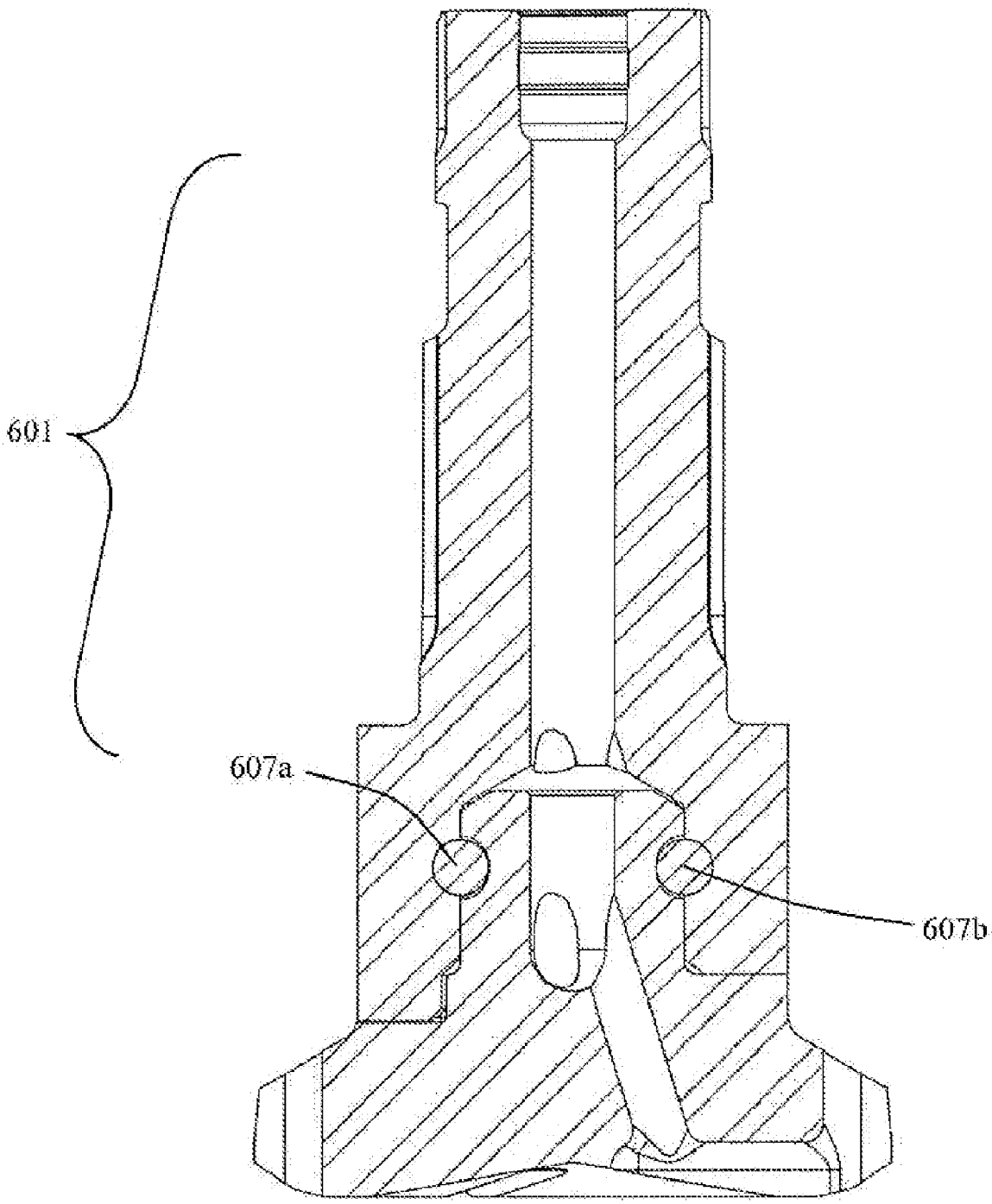
FIG. 10*a* is a cross-sectional view of a drill bit assembly having two retaining members engaging the outer surface of the center stud of the bit.

FIG. 10*a* shows a cross sectional view of drill bit assembly 601 with retaining members 607*a* and 607*b*.

Figure 11:
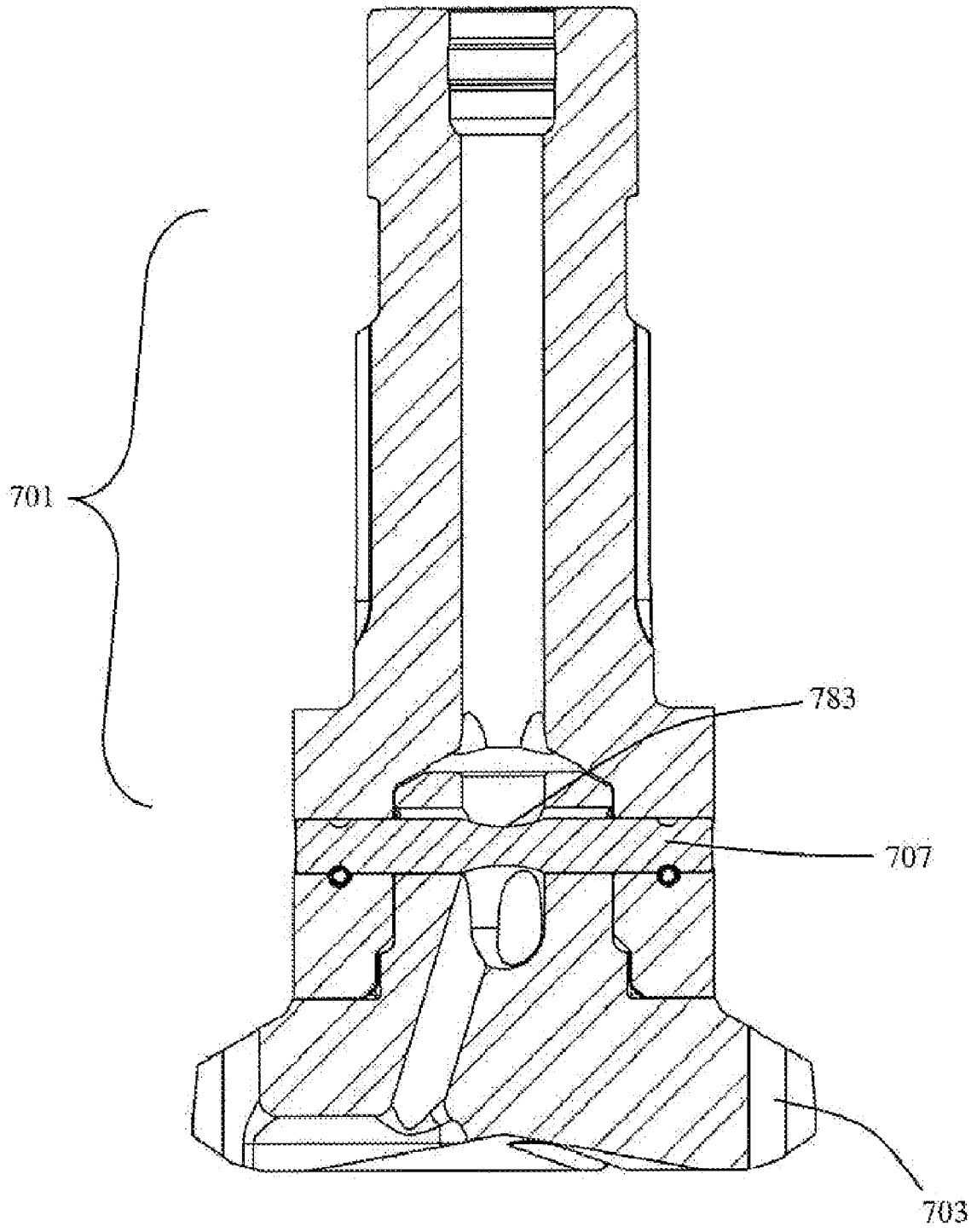
FIG. 11 is a cross sectional view of a drill bit assembly wherein the drill bit assembly employs only one retaining member that goes through both bit and shank passages.

FIG. 11 shows an alternate embodiment. Drill bit assembly 701 has variation on the retaining members 7*a* and 7*b* shown in the first embodiment in FIGS. 2-4. FIG. 11 shows only one retaining member 707 that can be installed from either side and extracted from either side. The retaining member 707 is narrowed in diameter in the mid-section 783 to assist in minimizing air flow restriction thru the bit 703.

Figure 12:
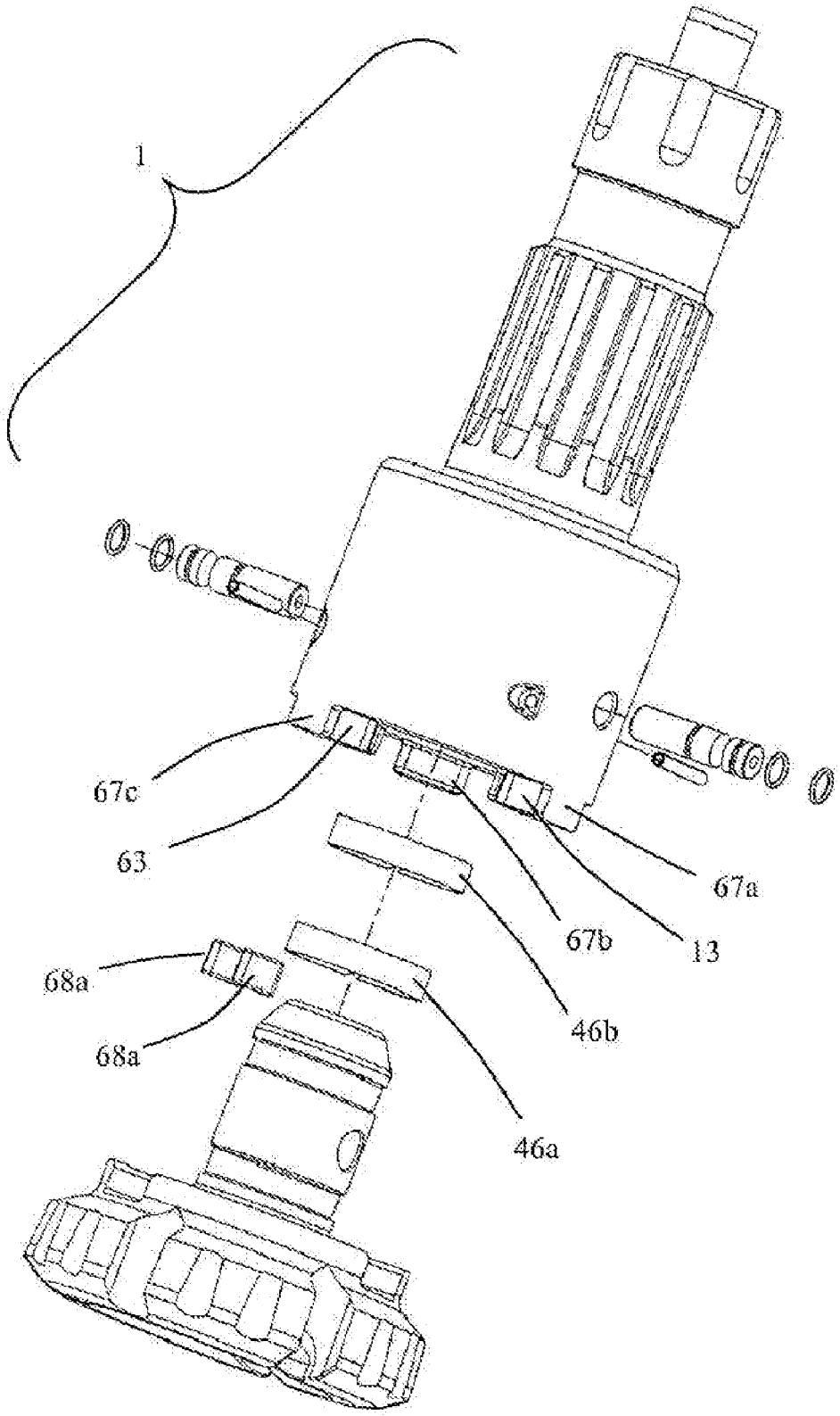
FIG. 12 is an isometric exploded view of a drill bit assembly with wear bands on the shank.

FIG. 12 shows first embodiment drill bit assembly 1. Drive lugs 67*a*, 67*b* and 67*c* on Shank 5 have lug wear bands 68*a* and 68*a*'. Wear band 68*a* is located on clockwise shank surface 13. Wear band 68*a* is located on counterclockwise shank surface 63.

The center stud 45 of the bit 3 has center stud wear bands 46*a* and 46*b*.

The lug wear bands 68*a* and 68*a*' and the center stud wear bands 46*a* and 46*b* improve the longevity of the product by helping to reduce non-beneficial steel on steel contact.

FIG. 13 shows the first embodiment of the bit 3. Pockets 16*a*, 16*b*, 16*c* have pocket wear bands 20*a*, 20*a*', 20*c*, and 20*c*'. Pocket wear bands 20*a*, 20*b*, and 20*c* are located on clockwise bit surfaces 43. Pocket wear bands 20*a*', 20*b*', 20*c*' are located on counterclockwise bit surfaces 18.

Figure 14:
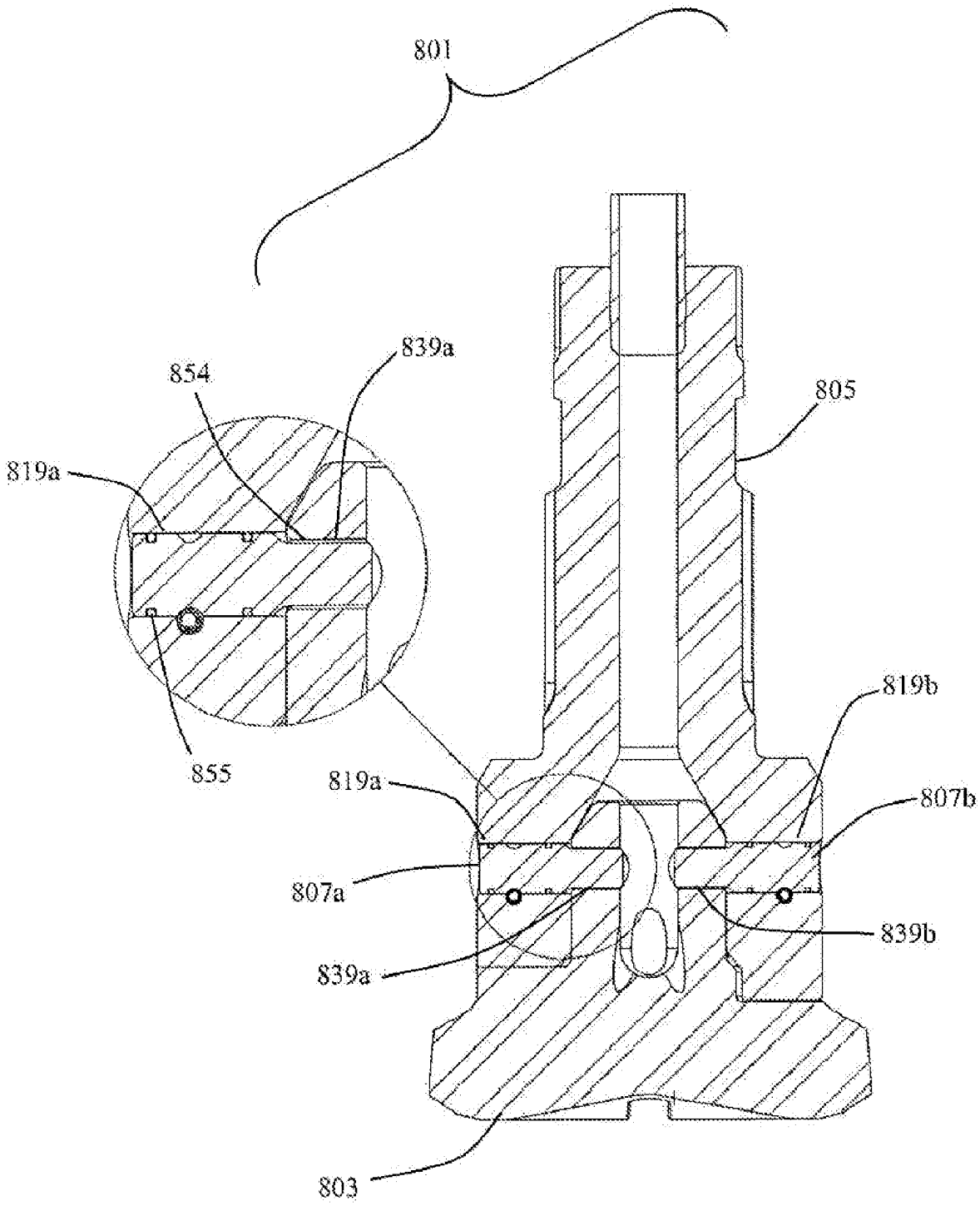
FIG. 14 is a cross section view of the drill bit assembly having a bit passage area smaller than the shank passage area with a magnified view of the retaining member.

FIG. 14 shows a cross section of an alternate embodiment. Drill bit assembly 801 has a bit 803 having bit passages 839*a* and 839*b* to receive retaining members 807*a* and 807*b*. Shank 805 has shank passages 819*a* and 819*b* to receive retaining members 807*a* and 807*b*. The circumferential area of bit passage 839*a* and 839*b* is smaller than the circumference area of shank passages 819*a* and 819*b*. When the shank 805 and the bit 803 are engaged and rotating during drilling retaining members 807*a* and 807*b* do not touch a bit passage surface 854. Alternatively and not shown, the retaining members 807*a* and 807*b* could be altered so that when the shank and the bit 803 are engaged and rotating during drilling the retaining members 807*a* and 807*b* do not touch a shank passage surface 855.

Figure 15:
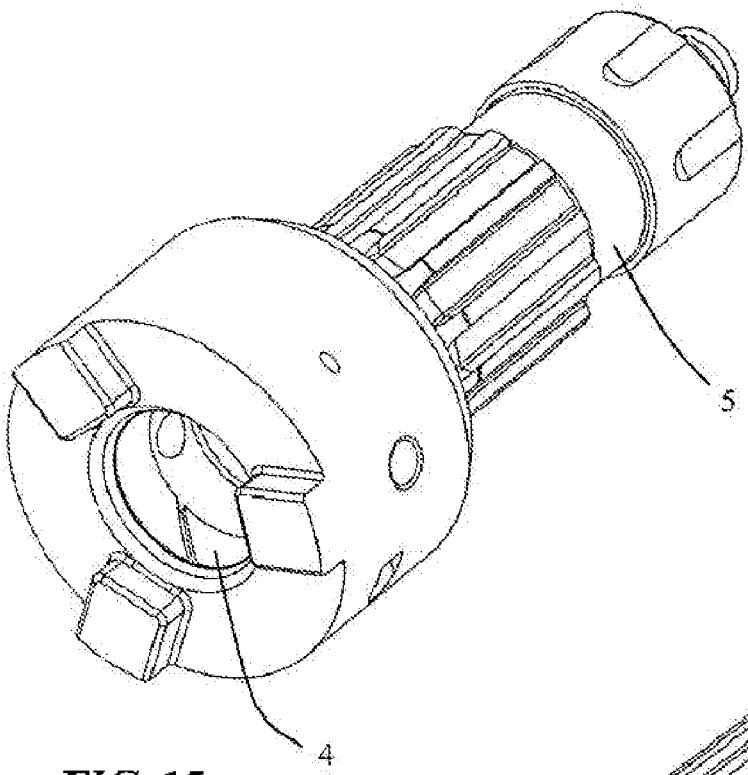
FIG. 15 is an isometric view of the shank having a wear band.
Figure 15A:
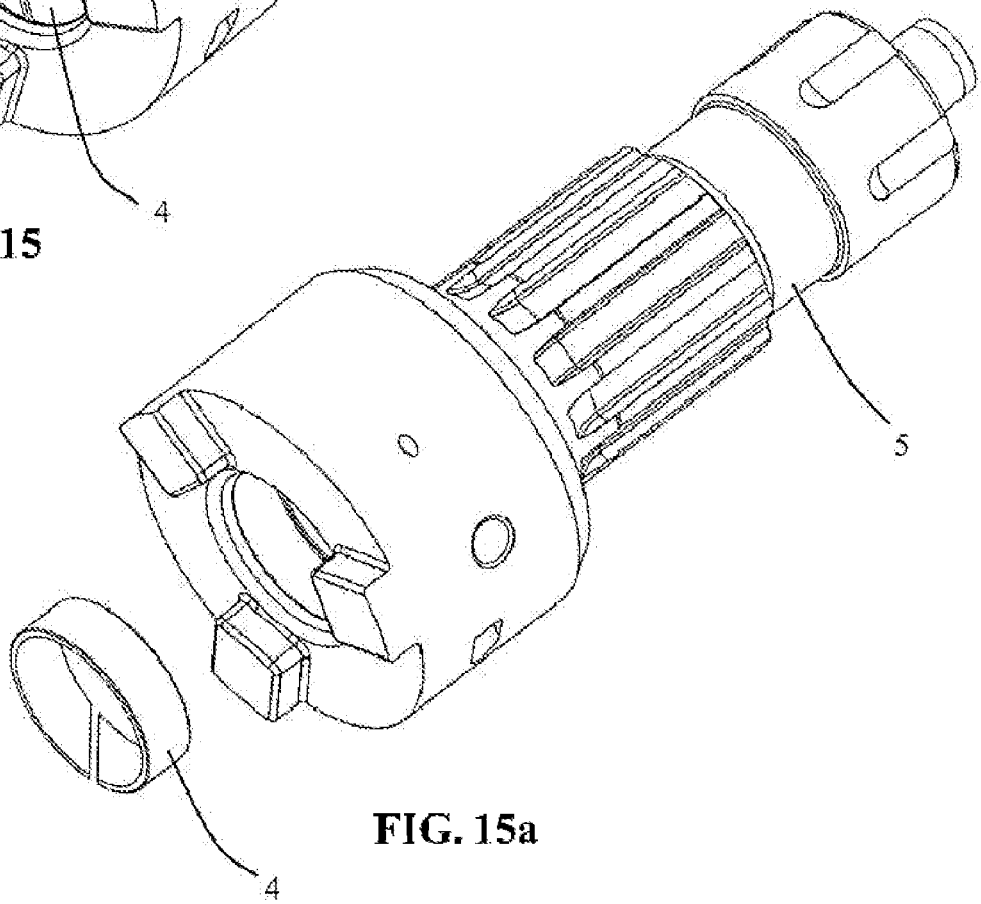
FIG. 15*a* is an isometric exploded view of the shank having a wear band.

FIG. 15 shows a shank 5 having a wear band 4. FIG. 15*a* is an exploded view of shank 5 having a wear band 4.

Figure 16:
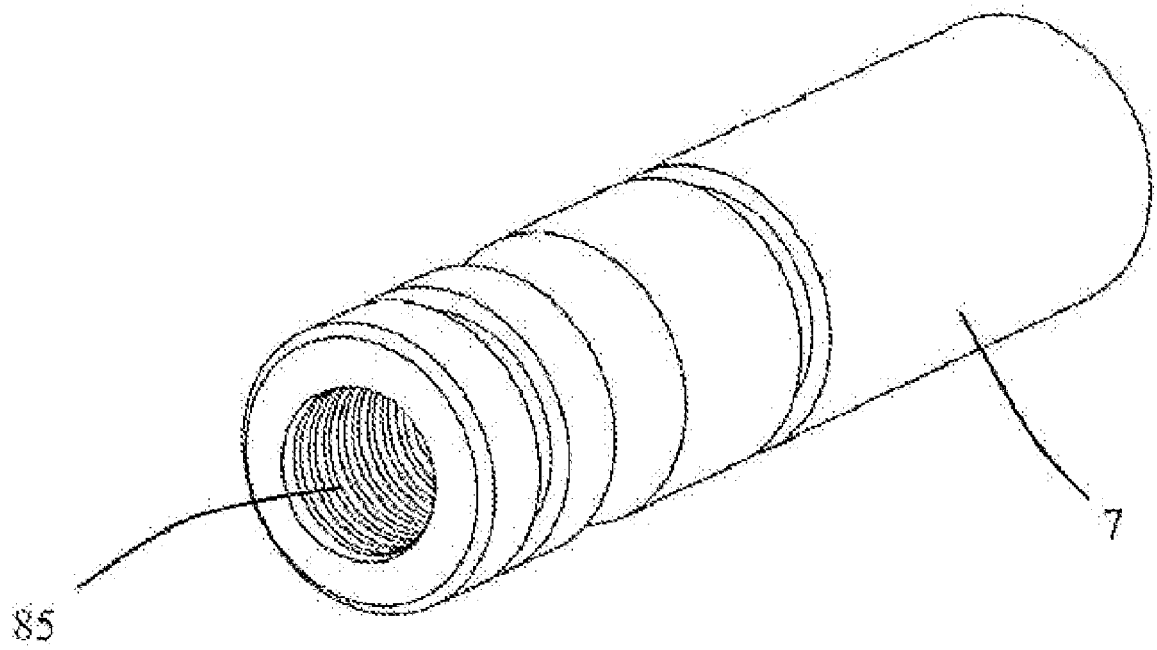
FIG. 16 is an isometric view of a threaded retaining member.

FIG. 16 shows a retaining member 7. Retaining member 7 is cylindrical and hollow. Retaining member 7 has internal threads 85.

Figure 17:
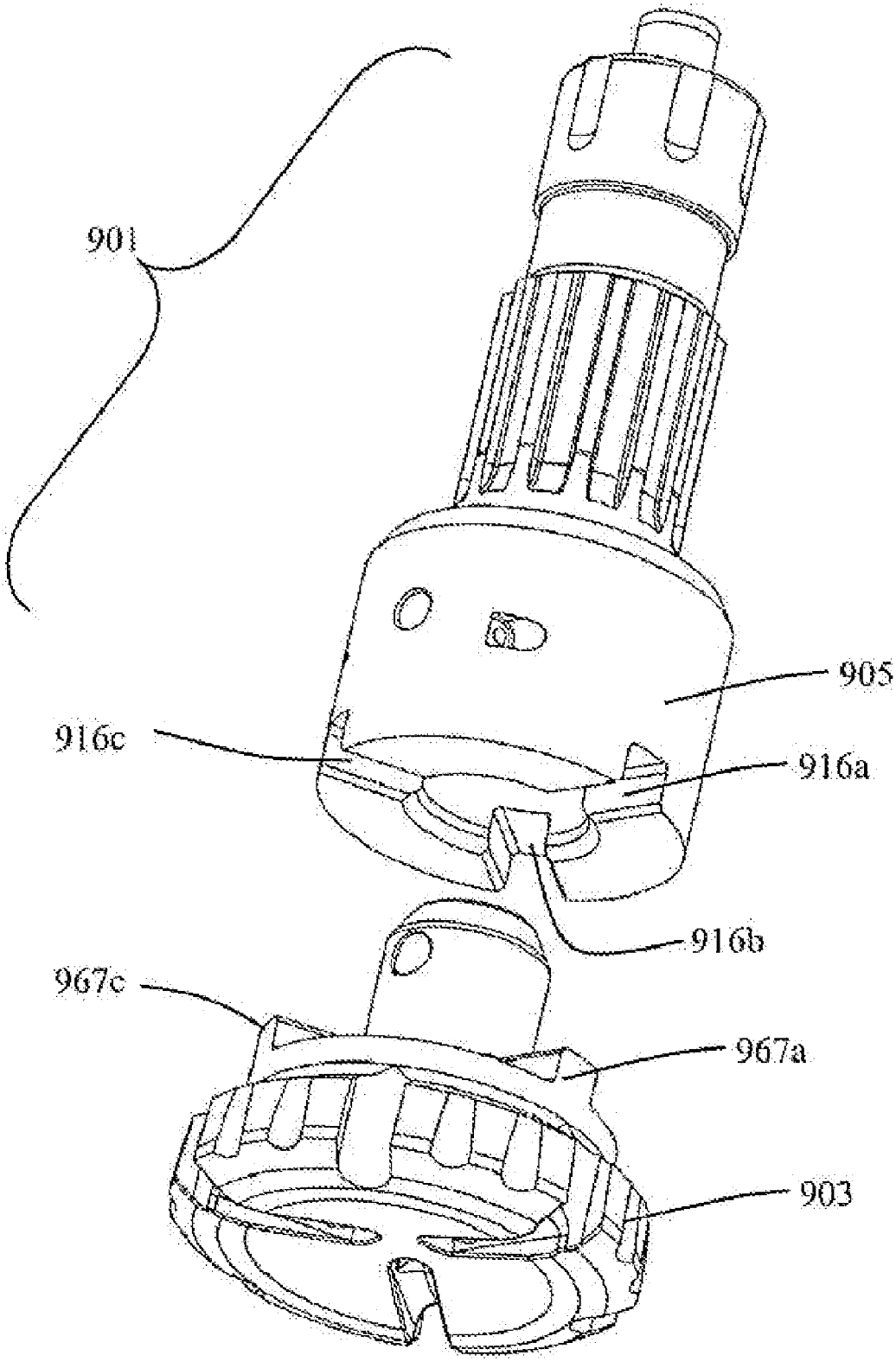
FIG. 17 is an isometric exploded view of a drill bit assembly having pockets on the shank and lugs on the bit.

FIG. 17 shows an alternate embodiment. Drill bit assembly 901 has a bit 903 and a shank 905. This alternate embodiment is similar to the first embodiment except drive lugs 967*a*, 967*b* (not shown), and 967*c* are located on the bit 903 and pockets 916*a*, 916*b*, and 916*c* are located on shank 905.

FIGS. 19-23 show another embodiment of the first embodiment of the bit assembly. This embodiment of the bit assembly 980 shows variations of the first embodiment of the bit assembly.

The bit assembly 980 shows a shank 981 that is inserted on top of a stud 982 of a bit 983. The shank 981 has shank passages 984. The stud 982 has a groove or channel 985. The shank 981 has lugs 986 that engage bit pockets 987 when the shank 981 is inserted over the stud 982 of the bit 983. When the shank 981 is engaged with the bit 983 retaining members 988 are inserted into the channel 985 in the stud 982 of the bit 983. The groove 985 has a vertical width that is larger than the thickness of the retaining members 988.

When the retaining members 988 are inserted through the shank passages 984 and the shank 981 is resting on the bit 983 there is no contact made with an upper portion 989 of the channel 985. This is because: (i) the channel 985 vertical width is greater than the thickness of the retaining members 988; and (ii) the vertical alignment of the shank passage 984 and the channel 985 are designed so that there is a clearance between a top surface 990 of the retaining members 988.

The result of this is that when there is a downward percussive axial force applied to the shank that force is transmitted to the bit and no force is applied to the retaining members 988. That means while drilling there is no shear force applied to the retaining members 988 while drilling with a downward percussive axial force.

When the shank is rotated the pockets 987 and lugs 986 assume the rotational force transmitted from the shank 981 when it is rotated and thereby transmitting rotational forces from the shank 981 to the bit 983. The channel 985 into which the retaining members 988 are inserted avoids any shear force applied to the retaining members 988 during rotational movement of the shank 981 relative to the bit 983.

When the shank 981 is vertically or upwardly lifted to withdraw the bit assembly 980 from the down hole, the top surface 990 will engage the surface of the upper portion 989 of the channel 985. This enables the bit 983 to be removed with the shank 981 when the shank is lifted out of the down hole. At this point there is a shear force applied to the top surface 990 of the retaining members 988.

In order to spread the applied shear force applied to the top surface 990 of the retaining members 988 when the bit assembly 980 is lifted from the down hole, the top surface 990 of the retaining members 988 is a planar surface rather than an arcuate or round surface. This planar surface provides a plane contact between the top surface 990 and the upper portion surface 989 of the channel 985. A round surface or arcuate surface on the retaining members would present line contact at the point of shear force application to the retaining members and will have the effect of resulting in failure of the retaining members. The retaining members would break.

A band 991 surrounds the retaining members 988 that are inserted into the shank passages 984 to keep the retaining members 988 in the passages.

Another Embodiment

Figure 24:
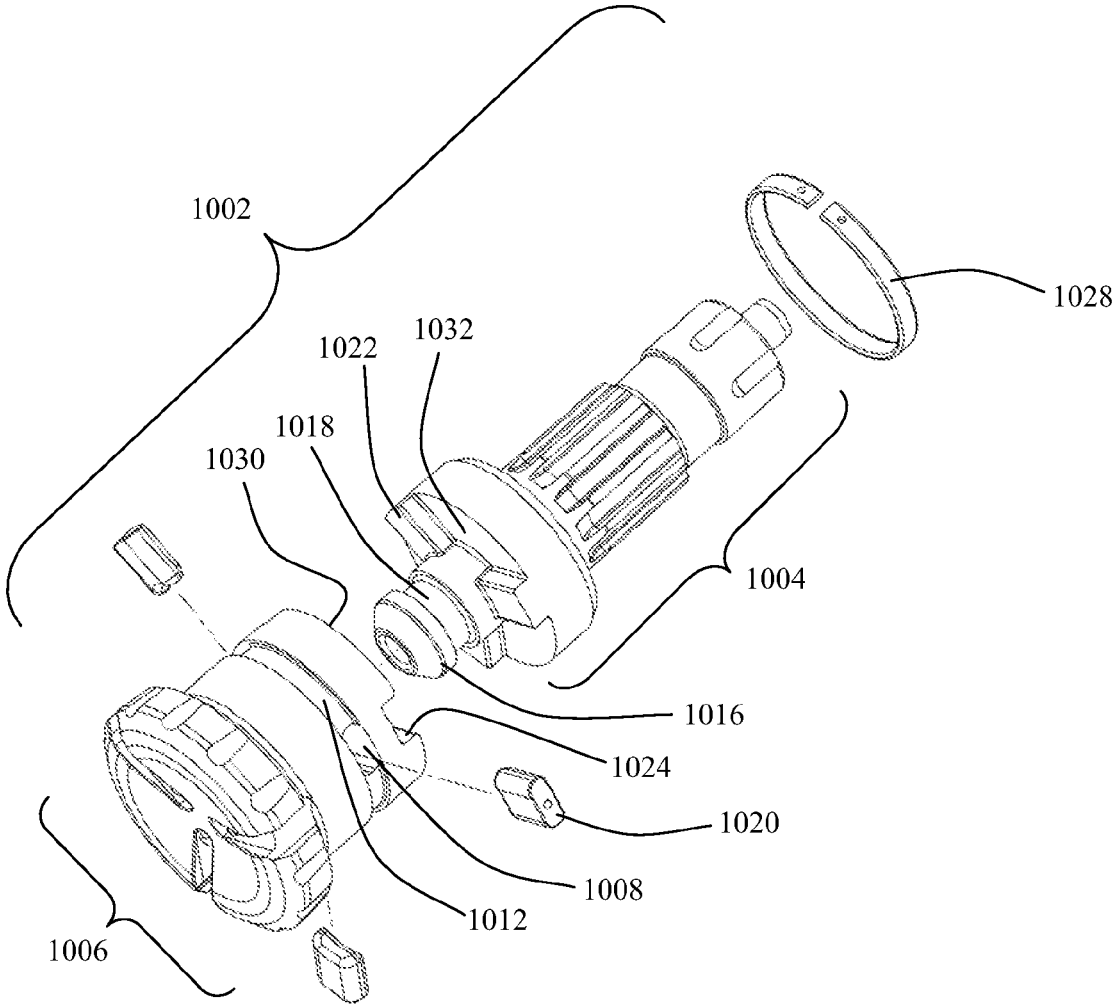
FIG. 24 is an isometric exploded view of another embodiment of the bit assembly.
Figure 25:
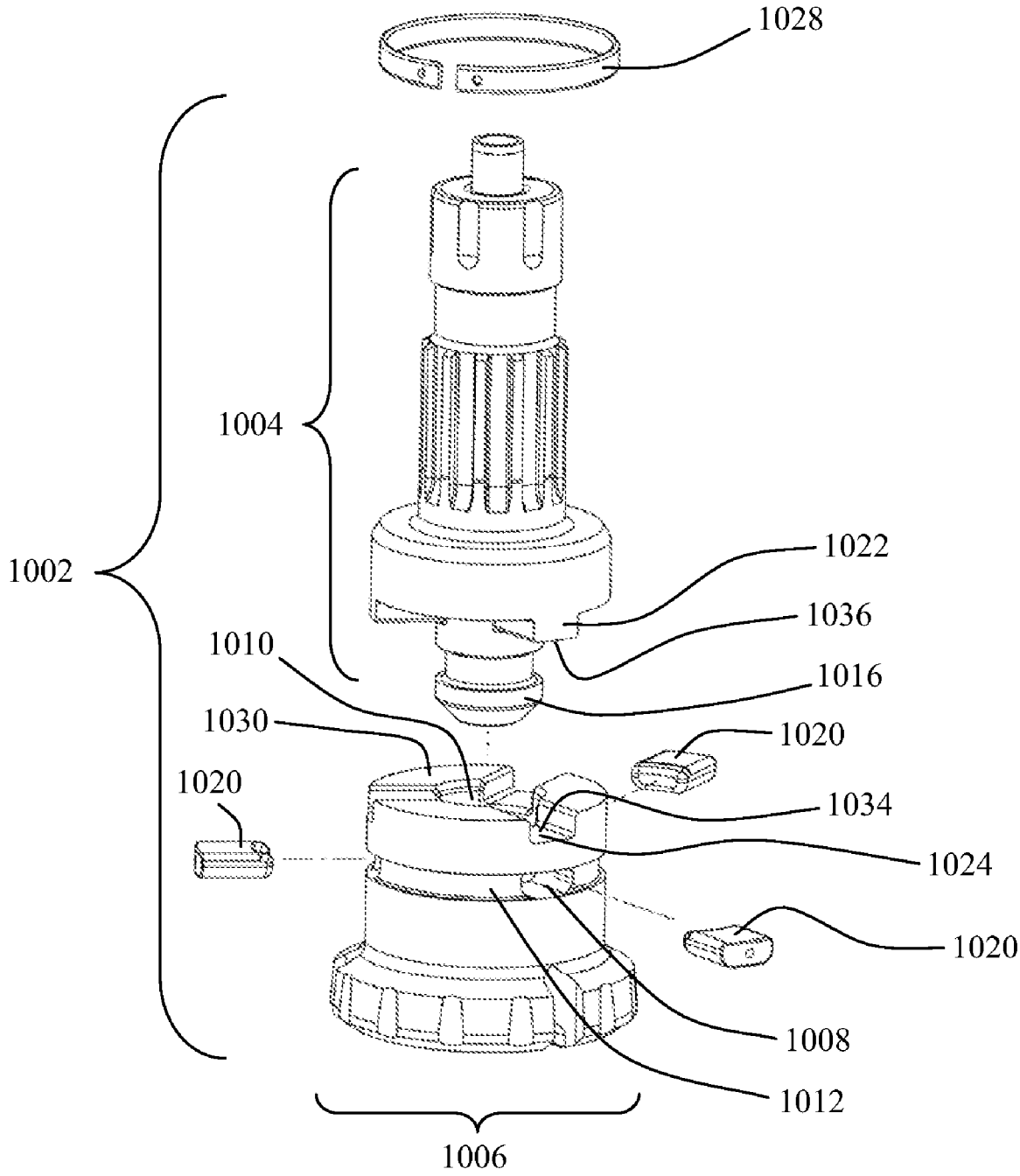
FIG. 25 is an isometric exploded view of the embodiment shown in FIG. 24 showing the view from another angle.
Figures 26, 26A:
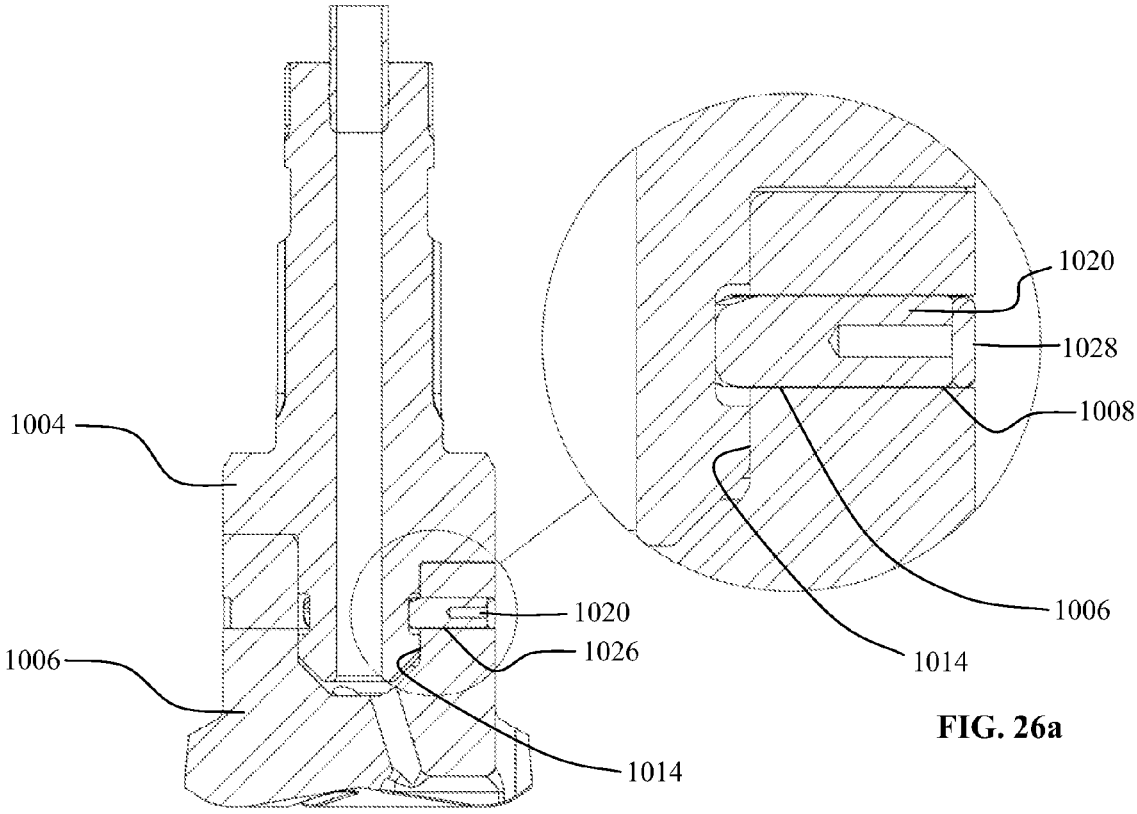
FIG. 26 is a sectional elevation view of the embodiment shown in FIG. 24 and FIG. 25.
FIG. 26*a* is an enlarged portion of the embodiment shown in FIG. 26.

Another embodiment of the drill assembly is shown in FIGS. 24-26. The drill bit assembly 1002 as shown in FIGS. 24-26 has a shank 1004 and a bit 1006. The bit 1006 has a bit passage 1008. The bit 1006 has a bit opening 1010. The bit passage 1008 starts at an outer surface 1012 and ends at an inner surface 1014 of the bit 1006 in the opening 1010.

The shank 1004 has a center stud 1016. This center stud has an area so that the center stud can fit into the bit opening 1010 of the bit 1006 when the bit 1006 and the shank 1004 are assembled. The center stud 1016 has a shank passage 1018 in the form of a channel. When the shank 1004 and the bit 1006 are assembled, the bit passage 1008 and the shank passage 1018 are aligned.

A retaining member 1020 is positioned inside the bit passage 1008 and extends into the shank passage 1018 which is in the form of a channel. The retaining member 1020 is removable so that the bit 1006 and the shank 1004 can be separated when the retaining member 1020 is removed. A complementary lug 1022 on shank 1004 engages a complementary pocket 1024 on the bit 1006. The engagement of the complementary lug 1022 and the complementary pocket 1024 allows the shank 1004 and the bit 1006 to rotate together, whereby the complementary lug 1022 and the complementary pocket 1024 communicate rotational forces whenever the bit assembly 1002 is rotated.

The bit passage 1008, the shank passage 1018 in the form of a channel, the retaining member 1020, the shank 1004 and the bit 1006 are configured and combined in such a manner that when a downward percussive axial force is applied during a drilling operation to the shank 1004 and transmitted to the bit 1006, there is no shear force applied to the retaining member 1020. When rotating the shank 1004 relative to the bit 1006 there is no shear force applied to the retaining member 1020. Lifting the shank 1004 coupled to the bit 1006 there is a shear force applied to the retaining member 1020. This is because to lift the bit 1006 with the shank 1004 when the shank 1004 is lifted upward the retaining member 1020 lifts the bit 1006.

The retaining member 1020 has a rectangular cross-sectional area and the shank passage 1008 has a rectangular cross-sectional area. The retaining member 1020 has a bottom planar surface 1026. This bottom planar surface 1026 was designed to remove radial forces generated by an angle of contact during extraction. A band 1028 surrounds the bit 1006 at outer surface 1012 to keep the retaining member 1020 in the bit passage 1008.

A bit percussive force surface 1030 is formed on the bit 1006 to receive axial impact energy from the shank 1004. The drill bit 1006 can have a wear pad not shown on the complementary pocket 1024 in the bit 1006. The shank 1004 has a shank percussive force surface 1032 formed on the shank 1004 to apply impact energy to the bit 1006 on the bit percussive force surface 1030.

The drill bit 1006 has a complementary pocket 1024 that has a surface 1034 normal to the direction of impact from the shank 1004.

The shank 1004 has a lug 1022 that has a surface 1036 that is normal to the direction of impact between the shank 1004 and the bit 1006. The normal surface 1036 does not make contact with the surface 1034 of drill bit 1006 during any phase of operation of the drill bit assembly 1002.

Another Embodiment

Figure 27:
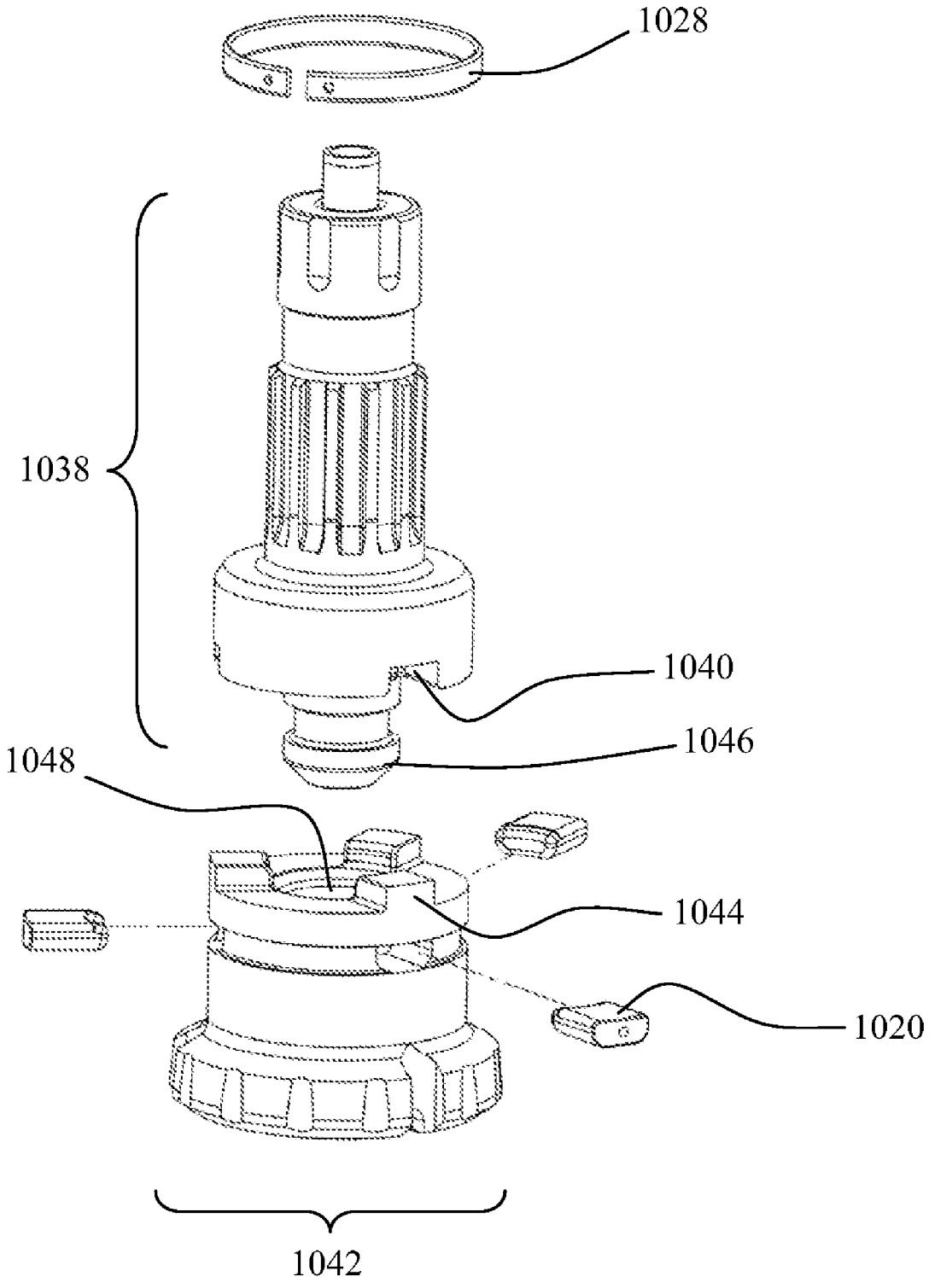
FIG. 27 is an isometric exploded view of another embodiment shown of the bit assembly.

FIG. 27 shows another embodiment very similar to the embodiment shown in FIGS. 25-26, except the complementary pockets and lugs are the exact reverse of what is shown in those preceding figures. The shank 1038 in the embodiment of FIG. 27 shows a complementary pocket 1040. The bit 1042 has a complementary lug 1044. The complementary lug 1044 and the complementary pocket 1040 engage one another when the shank 1038 and the bit 1042 are assembled and the stud 1046 on the shank 1038 is inserted into the opening 1048 of the bit 1042. The complementary pocket 1040 on the shank 1038 can have a wear pad which is not shown. The shank 1038 can have a wear pad not shown on the center stud 1046.

The method of coupling the shank 1004 with a drill bit 1006 is designed to avoid the application of a rotational shear force that is rotational torsion or movement generating or producing a force on the retaining member 1020 when rotating the shank 1004 relative to the bit 1006. An axial shear force is applied to the retaining member 1020 when applying an extraction force to the shank 1004 to lift the shank 1004 from a down hole and lift the bit 1006 with the shank 1004. No rotational forces are communicated through the retaining member 1020 in any of the drilling operations or the extraction of the drill from the down hole operation. All rotational forces are carried through the lug 1022 and complementary pocket 1024. The opening 1010 in the drill bit 1006 can have a wear band not shown in the drawings.

Various changes could be made in the above construction and method without departing from the scope of the invention as defined in the claims below. It is intended that all matter contained in the above description as shown in the accompanying drawings shall be interpreted as illustrative and not as a limitation.

We claim:

1. A method of coupling a shank with a drill bit to avoid the application of a rotational shear force on a retaining member of the coupled shank and bit when rotating the shank relative to the bit and avoid the application of a downward shear force on the retaining member when applying percussive axial force to the shank during drilling and when applying an extraction force to the shank to upwardly lift the shank coupled to the bit there is a shear force applied to the retaining member comprising:

a. providing a shank having a center stud that can fit into an opening in a bit when the bit and the shank are assembled, the center stud having a shank passage;

b. providing a bit having a bit passage, the bit has an opening to receive the center stud when the bit and shank are engaged;

c. providing a retaining member;

d. providing a complementary lug and pocket structure in which the shank has either a pocket or a lug and the bit has either a complementary lug or pocket in which the lug and pocket are engaged when the bit and the shank are engaged;

e. engaging the shank with the bit and engaging the complementary lug and pocket structure; and f. inserting the retaining member through aligned passages of the shank and the bit, wherein the bit passage, shank passage, retaining member, shank and bit are configured and combined in such a manner that when a downward percussive axial force is applied to the shank and transmitted to the bit while drilling there is no shear force applied to the retaining member and when rotating the shank relative to the bit there is no shear force applied to the retaining member and when upwardly lifting the bit coupled to the shank there is a shear force applied to the retaining member.

2. The method as recited in claim 1 wherein the retaining member has a rectangular cross-sectional area and the shank passage has a rectangular cross-sectional area.

3. The method as recited in claim 1 wherein the retaining member has a bottom planar surface.

4. The method as recited in claim 1 including providing a band surrounding the bit to keep the retaining member in the bit passage.

5. The method as recited in claim 1 wherein the shank passage is in the form of a channel.

6. A drill bit assembly comprising:

a. a bit having a bit passage, the bit has an opening, the bit passage starts at an outer surface of the bit and ends at an inner surface of the bit in the opening of the bit;

b. a shank having a center stud, the center stud having an area so that the center stud can fit into the opening of the bit when the bit and shank are assembled, the center stud having a shank passage in the form of a channel, when the shank and the bit are assembled the bit passage and the shank passage are aligned;

c. a retaining member inside the bit passage and extending into the shank passage when the shank and bit are assembled, the retaining member is removable so that the bit and shank can be separated when the retaining member is removed;

d. a complementary lug or pocket on the shank; and e. a complementary lug or pocket on the bit that engages the complementary lug or pocket of the shank, the engagement of the lug and the pocket allow the shank and bit to rotate together, whereby the lug and the pocket communicate rotational forces.

7. A drill bit assembly as recited in claim 6 including a band on the bit surrounding the retaining member inside the bit passage to keep the retaining member in the bit passage.

8. A drill bit for use in coupling a shank with the drill bit to form a drill bit assembly comprising:

a. a bit having an opening to receive a stud on the shank, the bit having a bit passage to receive a retaining member, the bit passage starts at an outer surface of the bit and ends at an inner surface of the bit in the opening of the bit;

b. a bit percussive force surface formed on the bit to receive impact energy from the shank; and c. a complementary pocket or lug on the bit to receive a complementary lug or pocket on the shank.

9. A drill bit as recited in claim 8 wherein the complementary pocket or lug on the bit has a surface normal to the direction of impact.

10. A drill bit as recited in claim 8 wherein the pocket on the bit has a wear pad.

11. A drill bit as recited in claim 8 wherein the opening of the bit has a wear band.

* * * * *